US009700181B1

(12) United States Patent
Santoro et al.

(10) Patent No.: US 9,700,181 B1
(45) Date of Patent: Jul. 11, 2017

(54) DISPENSER ASSEMBLY INCLUDING ENCLOSURE WITH HANDLE

(71) Applicant: Vi-Jon, Inc., St. Louis, MO (US)

(72) Inventors: Donna M. Santoro, St. Charles, MO (US); Andy Lee Kirkpatrick, Green Bay, WI (US); Kacey James Kreuter, Green Bay, WI (US); Stephen John Kocis, Suwanee, GA (US); William J. Peek, Lawrenceville, GA (US); Britt Babiarz, Alpharetta, GA (US); Anthony Toribio, Suwanee, GA (US)

(73) Assignee: Vi-Jon, Inc., St. Louis, MO (US)

( * ) Notice: Subject to any disclaimer, the term of this patent is extended or adjusted under 35 U.S.C. 154(b) by 0 days.

(21) Appl. No.: 15/253,022

(22) Filed: Aug. 31, 2016

(51) Int. Cl.

| | |
|---|---|
| ***B67D 7/06*** | (2010.01) |
| ***A47K 5/12*** | (2006.01) |
| ***A47K 5/14*** | (2006.01) |
| ***B05B 11/00*** | (2006.01) |
| ***B05B 15/06*** | (2006.01) |

(52) U.S. Cl.
CPC ..... *A47K 5/1211* (2013.01); *A47K 5/14* (2013.01); *B05B 11/0097* (2013.01); *B05B 11/3002* (2013.01); *B05B 11/3047* (2013.01); *B05B 11/3057* (2013.01); *B05B 11/3073* (2013.01); *B05B 15/061* (2013.01)

(58) Field of Classification Search
CPC ..... A47K 5/1211; A47K 5/12; A47K 5/14; B05B 11/0097; B05B 11/3002; B05B 11/3047; B05B 11/3057; B05B 11/3073; B05B 15/061; B65D 23/003
USPC ..... 222/181.3, 182, 181.2, 190
See application file for complete search history.

(56) References Cited

U.S. PATENT DOCUMENTS

| | | | | |
|---|---|---|---|---|
| 6,082,586 | A | 7/2000 | Banks | |
| 6,832,701 | B2 * | 12/2004 | Schiller | B65D 83/384 222/181.3 |
| 7,044,328 | B1 * | 5/2006 | Ciavarella | A47K 5/12 220/326 |
| 8,002,150 | B2 | 8/2011 | Ophardt et al. | |
| 8,071,933 | B2 * | 12/2011 | Ophardt | A47K 5/1217 222/181.1 |
| 8,091,739 | B2 | 1/2012 | Ophardt et al. | |
| 8,113,388 | B2 | 2/2012 | Ophardt et al. | |
| 8,272,539 | B2 | 9/2012 | Ophardt et al. | |
| 8,272,540 | B2 | 9/2012 | Ophardt et al. | |
| 8,397,949 | B2 | 3/2013 | Ophardt | |
| 8,413,855 | B2 | 4/2013 | Ophardt et al. | |
| 2009/0212073 | A1 * | 8/2009 | Haworth | A47K 5/1208 222/181.3 |

(Continued)

*Primary Examiner* — J. Casimer Jacyna
*Assistant Examiner* — Benjamin R Shaw
(74) *Attorney, Agent, or Firm* — Armstrong Teasdale LLP

(57) ABSTRACT

A dispenser assembly capable of dispensing gel, liquid, and foam products includes a container to be filled with the product, a pump connected to the container and configured to control dispensing of the product from the container, and a pump actuator assembly configured to actuate the pump and retain the container and the pump. The pump actuator assembly includes a first actuator including a lower ramp, and a second actuator comprising an upper ramp engaged with the lower ramp. The lower ramp of the first actuator and the upper ramp of the second actuator cooperate to actuate at least a portion of the pump along a first axis in response to a force applied along a second axis.

16 Claims, 22 Drawing Sheets

(56) References Cited

U.S. PATENT DOCUMENTS

| | | | | |
|---|---|---|---|---|
| 2011/0132933 | A1* | 6/2011 | Ophardt | F04B 53/14 222/181.3 |
| 2012/0080452 | A1* | 4/2012 | Boshuizen | G01F 11/00 222/181.3 |
| 2013/0292410 | A1* | 11/2013 | Pelkey | A47K 5/1202 222/52 |
| 2014/0091106 | A1* | 4/2014 | Ophardt | A47K 5/1207 222/181.3 |
| 2014/0166677 | A1* | 6/2014 | Flanagan-Kent | B65D 25/2867 220/661 |
| 2014/0231460 | A1* | 8/2014 | Pelkey | A47K 5/12 222/181.3 |
| 2017/0020347 | A1 | 1/2017 | Santoro et al. | |

* cited by examiner

DISPENSER ASSEMBLY INCLUDING ENCLOSURE WITH HANDLE

FIELD

This disclosure generally relates to dispensing a product, and more specifically, to a dispenser assembly for dispensing multiple formats of a cleaning, sanitizing, or other personal product.

BACKGROUND

To help with hand hygiene and skin care, dispensing systems distribute cleaning, sanitizing, and skin care products to a user. In institutional establishments such as hospitals, schools, restaurants, offices, and restrooms, dispensing systems are provided to reduce the risk of contamination and control the spread of harmful germs. These dispensing systems may be maintained, for example, in a vertical surface-mounted setting with a refill cartridge of hand sanitizer, liquid soaps, and/or other viscous skin care products. The designs of existing dispensers have a complexity and size that can negatively impact ease of use and cost.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF SUMMARY

One aspect of this disclosure is a dispenser assembly capable of dispensing gel, liquid, and foam products. The dispenser assembly includes a container configured to be filled with a product, a pump connected to the container and configured to control dispensing of the product from the container, and a pump actuator assembly configured to actuate the pump and retain the container and the pump therein. The pump actuator assembly includes a first actuator including a lower ramp, and a second actuator having an upper ramp engaged with the lower ramp. The lower ramp of the first actuator and the upper ramp of the second actuator cooperate to actuate at least a portion of the pump along a first axis in response to a force applied along a second axis.

Another aspect is a dispenser assembly including a container and a pump coupled to the container. The pump includes a chamber portion and a nozzle, and the pump is actuated in response to a force exerted along a first axis on the nozzle. The dispenser assembly also includes a pump actuator assembly connected to the nozzle of the pump. The pump actuator assembly is configured to cause a force along the first axis on the nozzle in response to a force applied along a second axis to the pump actuator assembly.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

Figure 1:
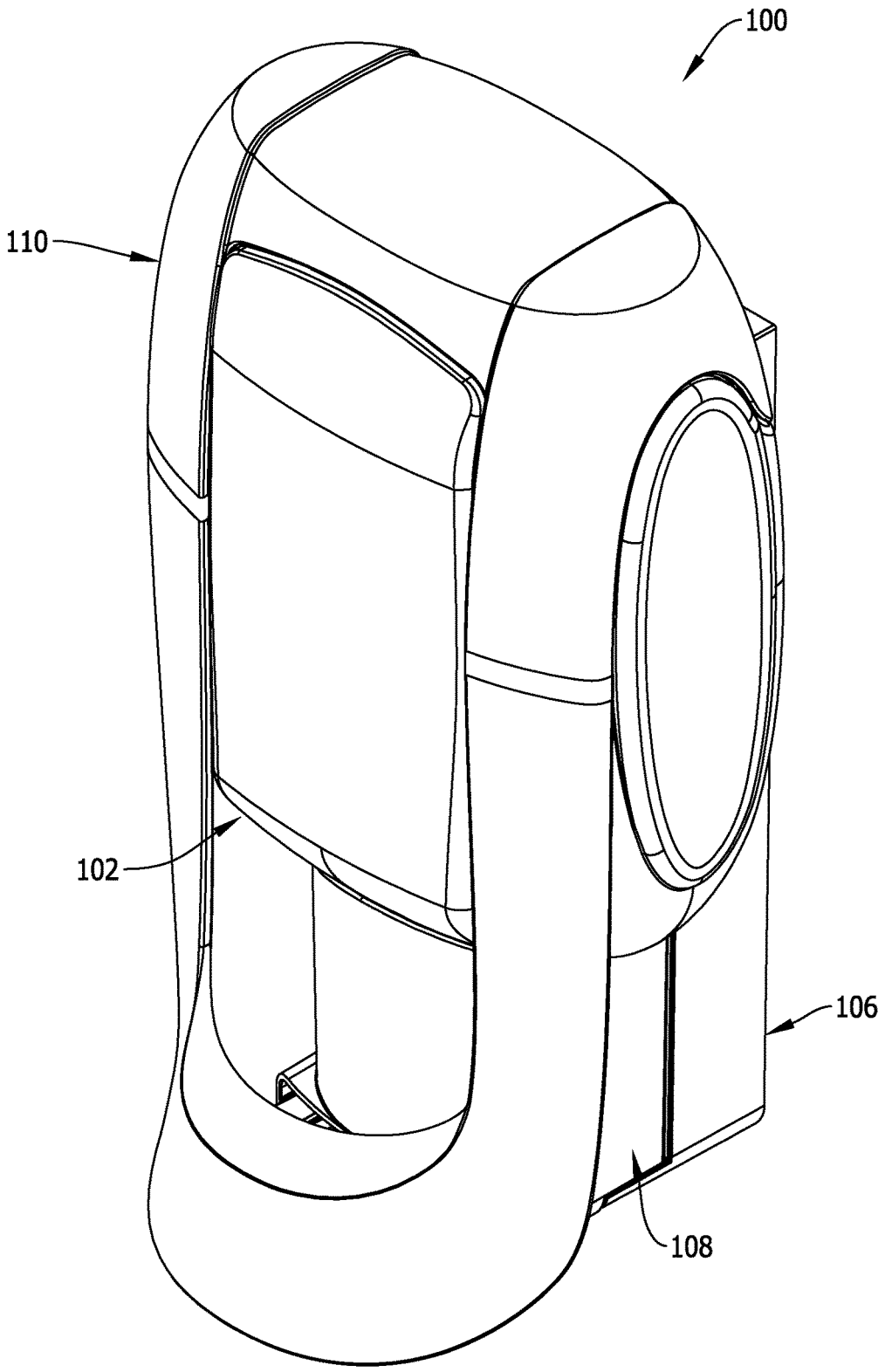
FIG. 1 is a perspective view of a dispenser assembly.

Referring to the drawings and in particular to FIG. 1, a dispenser assembly, generally indicated at 100, includes a bottle 102, a pump 104 (see, for example, FIGS. 4 and 5), a mounting component 106, a pump actuator assembly 108, and an enclosure 110. The dispenser assembly 100 is generally configured to dispense a hygiene product (not shown) therefrom. The product may include substantially any type of hygiene product, including a liquid, foam, and/or gel, such as hand sanitizer, soaps, or other personal products. As used herein, "liquid" refers to a product in a fully liquid state, "gel" refers to a product in a cross-linked state of liquid within a continuous solid phase, and "foam" refers to a product formed by trapping open-cell pockets or bubbles of gas within a liquid. As will be described in more detail below, the bottle 102 contains the product (e.g., a liquid, foam, or gel product) therein. As described in detail herein, when a user presses a handle portion of the enclosure 110 with his or her hand, the handle portion of the enclosure 110 engages with the pump actuator assembly 108 to actuate a nozzle of the pump 104. The nozzle is depressed upwardly and inwardly with respect to the dispensing assembly, and the product contained within the bottle 102 is dispensed from an opening included in the pump 104. Although a bottle 102 is shown and described herein, it should be understood that in other embodiments, alternative containers are used with the dispenser assembly 100, such as a bag, a tube, and/or any other container or vessel configured to hold product therein.

Figure 2:
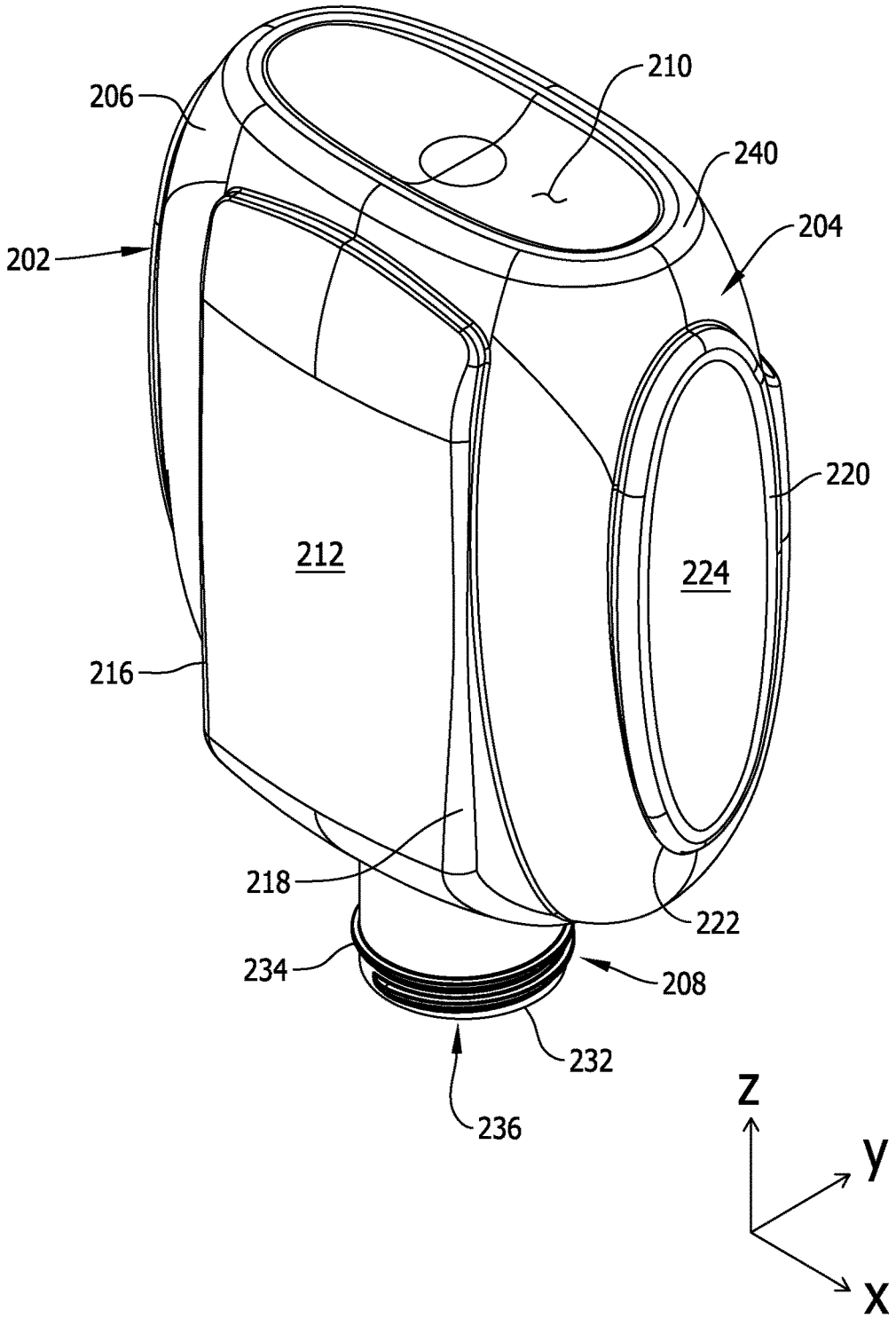
FIG. 2 is a perspective view of a bottle that may be used with the dispenser assembly shown in FIG. 1.
Figure 3:
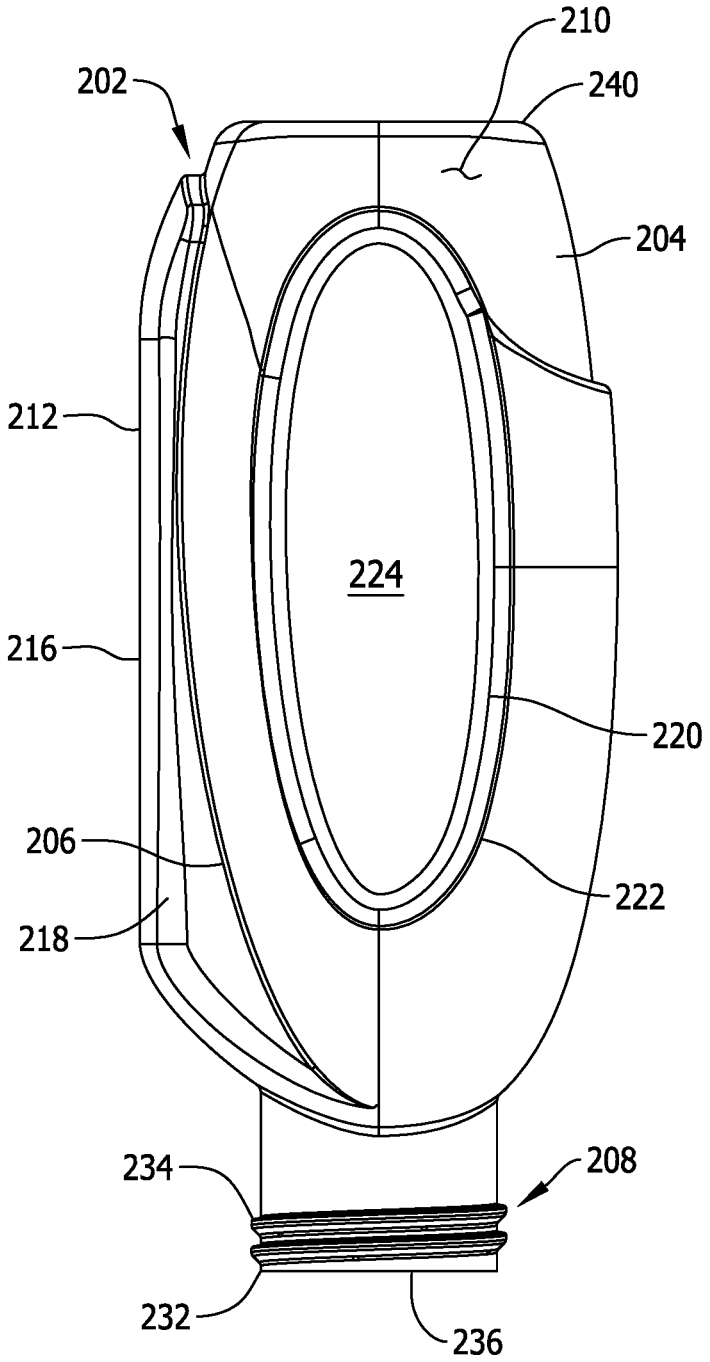
FIG. 3 is a side view of the bottle shown in FIG. 2.

FIGS. 2 and 3 are various views of the bottle 102 of the dispenser assembly 100 shown in FIG. 1. More particularly, FIG. 2 is a perspective view of the bottle 102, and FIG. 3 is a side view of the bottle 102. The bottle 102 generally includes a body portion 202, including opposing sides 204, a front 206, and a neck portion 208. The body portion 202 further includes a liquid chamber 210 defined therein and adapted to hold a quantity of product (e.g., a liquid, gel, or foam product). The body portion 202 further includes a bulge 212 defined thereon as well as a ridge 214 disposed on opposing sides 204 of the body portion 202 of the bottle 102, such that the enclosure 110 (shown in FIG. 1) may engage the body portion 202 of the bottle 102, as described later herein. The bulge 212 includes a front face 216 defined generally at the front 206 of the bottle 102, oriented generally parallel with an x-z plane as defined in FIG. 2. The bulge 212 also includes a side face 218 that extends at least partially around the bulge 212. The side face 218 is oriented generally perpendicular to the front face 216 (i.e., parallel with a y-z plane). The side face 218 defines a depth that allows flexible movement of the enclosure 110 about the bottle 102, as will be described in more detail herein.

The body portion 202 of the bottle 102 also includes an outwardly projecting rim 220 on opposing sides 204 of the bottle 102. The outwardly projecting rim 220 includes a generally elliptical edge 222, defining a concave recess 224 therein. The concave recess 224 is configured to enable easier handling of the bottle 102 by a user (e.g., a user installing the bottle 102 into the dispenser assembly 100 during initial installation or refill) by generally defining a grip thereon.

The neck portion 208 of the bottle 102 includes an externally threaded portion 232 having threads 234 disposed thereon. As will be described in further detail herein, the neck portion 208 is configured to engage with a collar portion of the venting pump 104 (shown in FIG. 4) to close the bottle 102 and contain the product therein without leakage of the product. The neck portion 208 generally defines an opening 236 to the bottle 102 from which product may be dispensed.

In this embodiment, the bottle 102 also includes a top 240 that is, as best seen in FIG. 3, substantially flat. By including the flat top 240, the bottle 102 is configured to be converted or easily inverted, e.g., from an upside-down position (i.e., with the opening 236 facing downwards) to a right-side-up position (i.e., with the opening 236 facing upwards), such that the bottle 102 may also be used as a stand-alone bottle 102 for containing a liquid product. Accordingly, the complete dispenser assembly 100 may be installed on, for example, a wall, and a stand-alone bottle 102 may be placed on, for example, a sink vanity, with the design aesthetic of the two dispensers (i.e., the dispenser assembly 100 and the bottle 102) unified. The bottle 102 may also include indicia disposed thereon (not shown) for branding purposes, description of the product contained therein, or any other purpose.

It should be understood that the bottle 102 may have different configurations, shapes, and sizes than those illustrated and described herein without departing from the present disclosure. The bottle 102 may be made of any suitable material such as, without limitation, polyethylene terephthalate (PET) or any other plastic or thermoplastic resin. The bottle 102 can be made in any desired color or colors, and may be transparent, translucent, or opaque.

Figure 4:
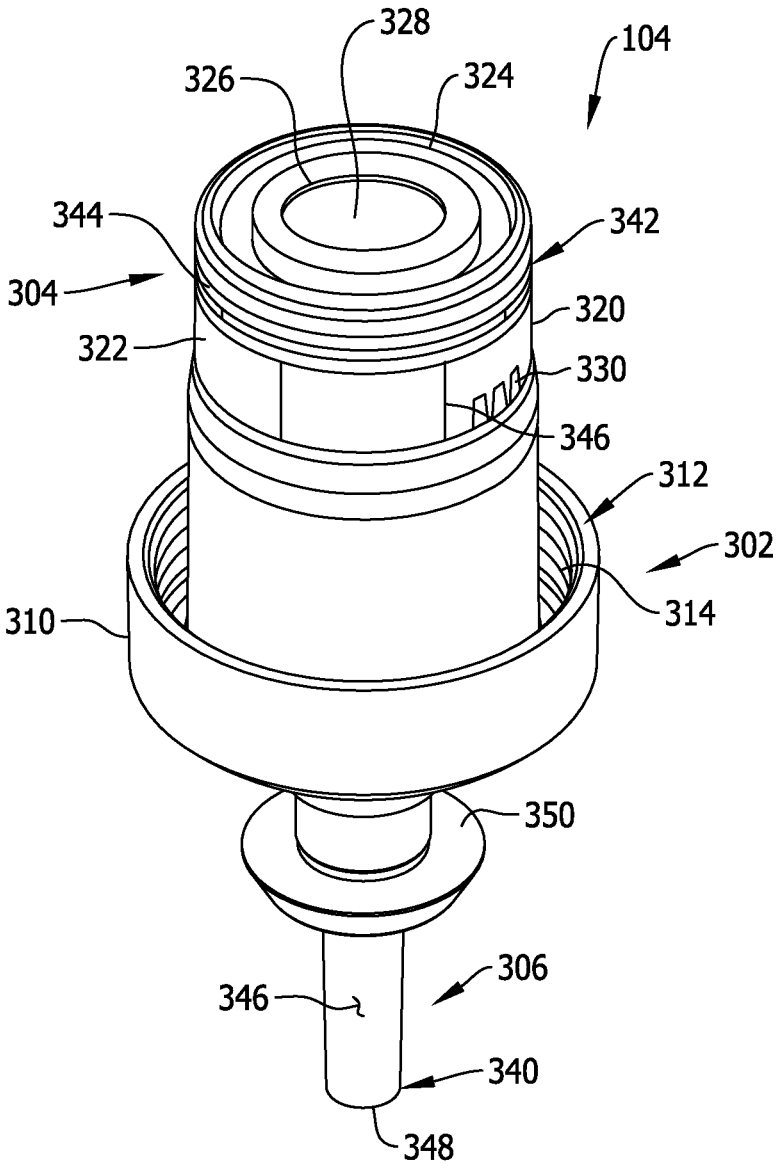
FIG. 4 is a perspective view of a venting pump that may be used with the dispenser assembly shown in FIG. 1.

Turning now to FIG. 4, a perspective view of the pump 104 of the dispenser assembly shown in FIG. 1 is illustrated. The pump 104 includes a collar portion 302, a chamber portion 304, and a nozzle portion 306. The pump 104 is configured to dispense one or more of a liquid product, a gel product, and a foam product. For example, the pump 104 may be used to dispense hand soaps, hand sanitizers, and lotions.

The collar portion 302 of the venting pump 104 includes a collar 310 and an internally threaded portion 312 concentric with and disposed radially inwardly from the collar 310. The internally threaded portion 312 includes threads 314 disposed thereon for threaded engagement with the threads 234 of the neck portion 208 of the bottle 102 (shown in FIGS. 2 and 3). The threads 234, 316 are suitably disposed such that the pump 104 will close the bottle 102 to prevent leakage of the product therefrom.

The chamber portion 304 of the venting pump 104 includes a generally cylindrical chamber 320 having a side wall 322 and an end wall 324. An opening 326 is defined in the end wall 324, and a passage 328 connects to the opening 326. The passage 328 extends axially through at least a portion of the chamber 320. The chamber 320 further includes vent holes 330 defined in the side wall 322 thereof.

The nozzle portion 306 includes a first end 340 from which product (contained in bottle 102) is dispensed. The nozzle portion 306 also includes a second end 342 opposite the first end 340. The second end 342 extends into the chamber 320. More specifically, the second end 342 includes a plunger 344 configured to slidably engage with an interior surface of the chamber 320 when the pump 104 is actuated to dispense product therefrom. Put another way, the nozzle portion 306 generally defines a "piston" within the chamber portion 304. The nozzle portion 306 also includes a passage 346 that extends through an opening or outlet 348 in the first end 340, from the first end 340 to the second end 342, and through the plunger 344. The passage 346 of the nozzle portion 306 extends around at least a portion of the passage 328 of the chamber 320.

When the pump 104 is actuated, the nozzle portion 306 is forced vertically upwards, causing the plunger 344 to slide upwards within the chamber 320. Product from the bottle 102 is drawn through the opening 326 in the chamber 320, through the passage 328, and, correspondingly, through the passage 346 of the nozzle portion 306. The product is pumped out of the outlet 348 at the first end 340 of the nozzle portion 306 in a liquid format, a gel format, or a foam format. The nozzle portion 306 is then drawn vertically downwards, as described further herein, thereby drawing the plunger 344 downwards to permit the chamber 320 to refill with product for the next dispensing. Reciprocal movement of the nozzle portion 306 between vertical positions will successively draw and pump precise amounts of product from the bottle 102. It should be understood that the use of "vertical" in this description is for illustrative purposes only and is non-limiting. In other words, the pump 104 need not be oriented exactly vertically for the pump 104 to function as described.

The nozzle portion 306 also includes an annular flange 350 that extends radially and horizontally from the channel 346 near the first end 340. As described further herein, the flange 350 provides a point of engagement between the pump actuator assembly 108 (shown in FIG. 1) and the nozzle portion 306.

In some embodiments, the chamber portion 304 and/or the nozzle portion 306 includes additional and/or alternative components. Some such components may enable the pump 104 to dispense various formats of product, such as foam, liquid, and/or gel. For example, the chamber portion 304 may include air and liquid chambers, such that a product dispensed from the dispenser assembly 100 will be in a viscous liquid state, and/or a foaming component (e.g., a mesh), such that the product is dispensed in a foam state. It should be understood that the pump 104 may have different configurations, shapes, and sizes than those illustrated and described herein without departing from the present disclosure. The pump 104 may be made of any suitable material such as, without limitation, any plastic or thermoplastic resin. Moreover, discrete elements of the pump 104 (e.g., the nozzle portion 306) may be made of a different material than other elements (e.g., the chamber portion 304 and/or collar portion 302). The pump 104 can be made in any desired color or colors, and may be transparent, translucent, or opaque.

Figure 5:
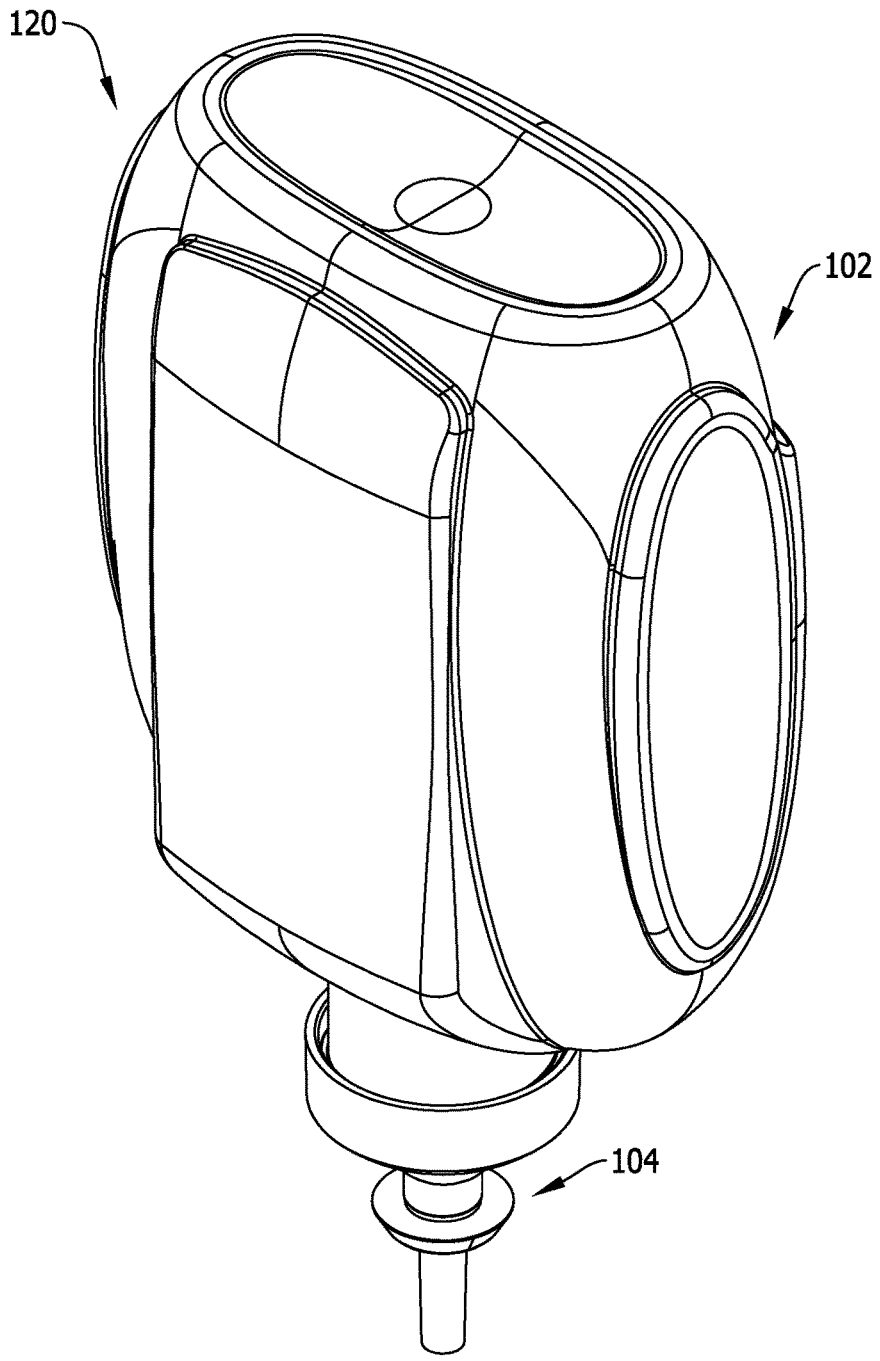
FIG. 5 is a perspective view of the dispenser assembly shown in FIG. 1 in an intermediate stage of assembly.

FIG. 5 is a perspective view of the dispenser assembly 100 shown in FIG. 1 in an intermediate stage of assembly. A partial assembly 120 includes the pump 104 coupled to the bottle 102 of the dispenser assembly 100. In the example embodiment, the nozzle portion 306 of the pump 104 (shown in FIG. 4) is oriented to project in an axial direction with respect to the bottle 102 to facilitate use of the dispenser assembly 100 as will be described in more detail below.

Figure 6:
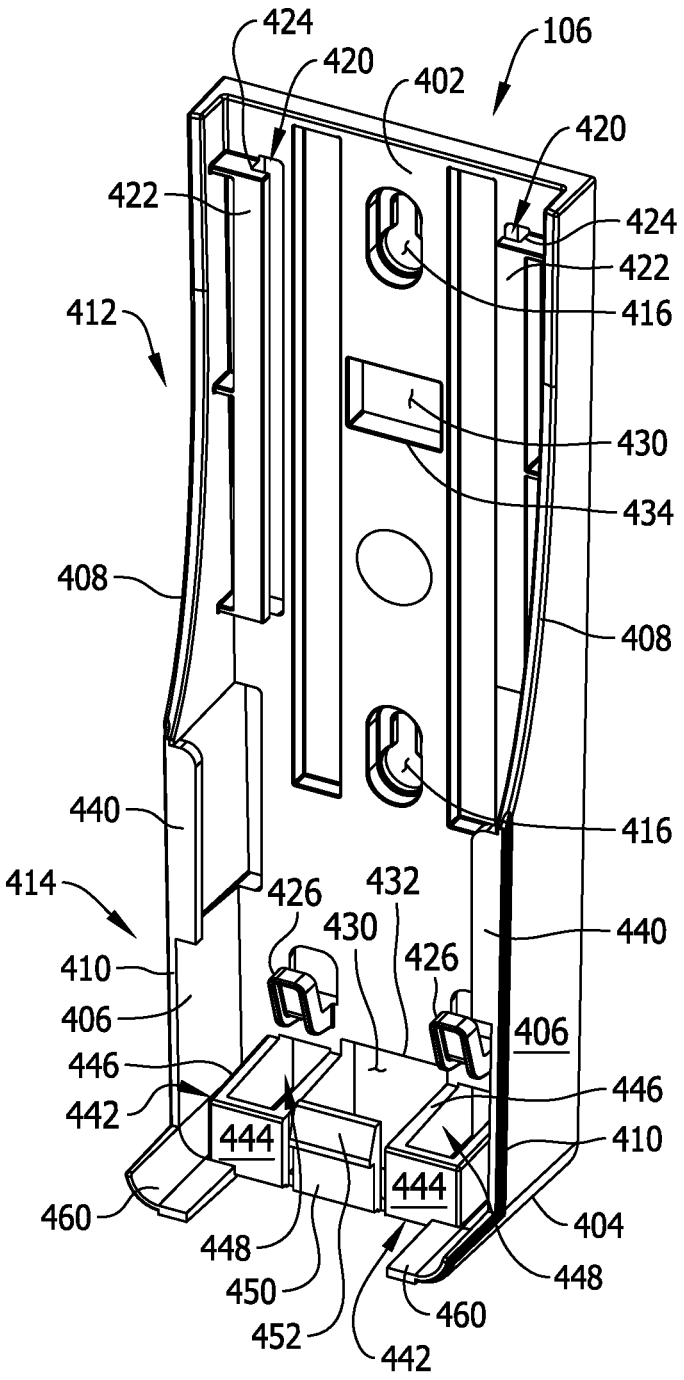
FIG. 6 is a perspective view of a mounting component that may be used with the dispenser assembly shown in FIG. 1.
Figure 7:
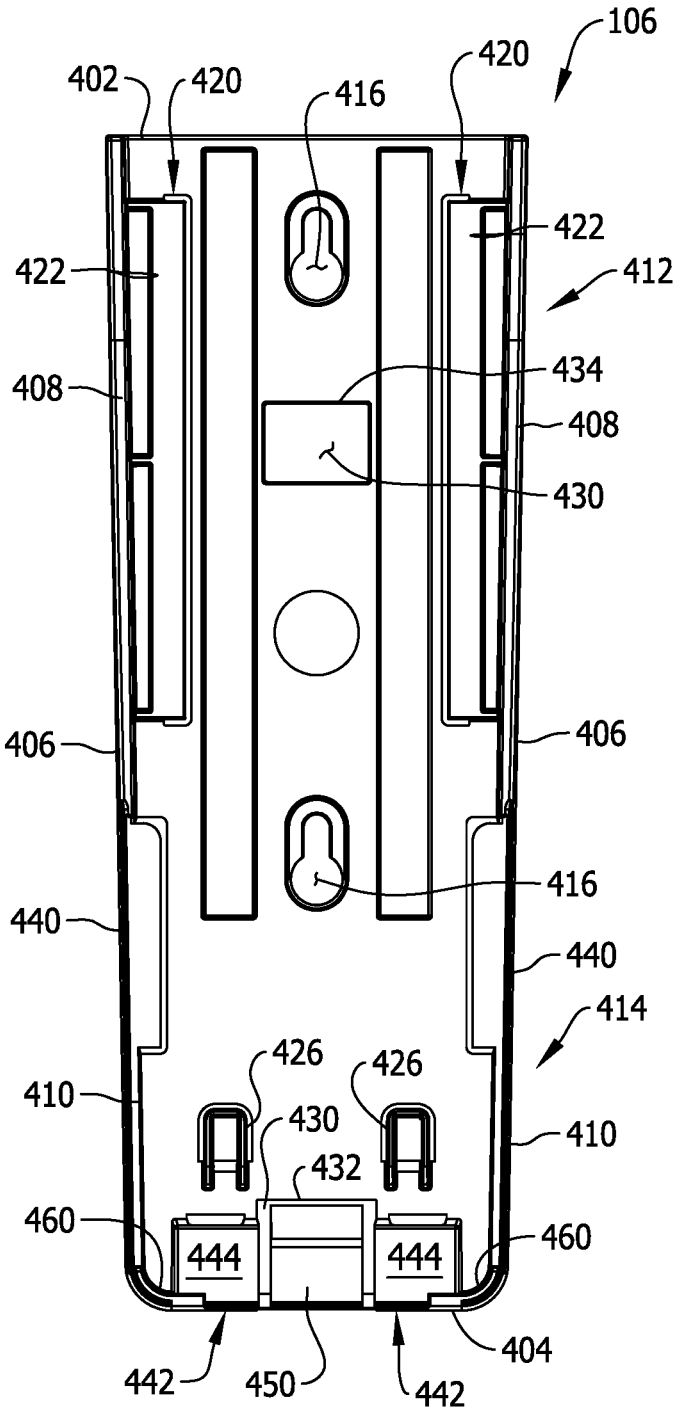
FIG. 7 is a front view of the mounting component shown in FIG. 6.
Figure 8:
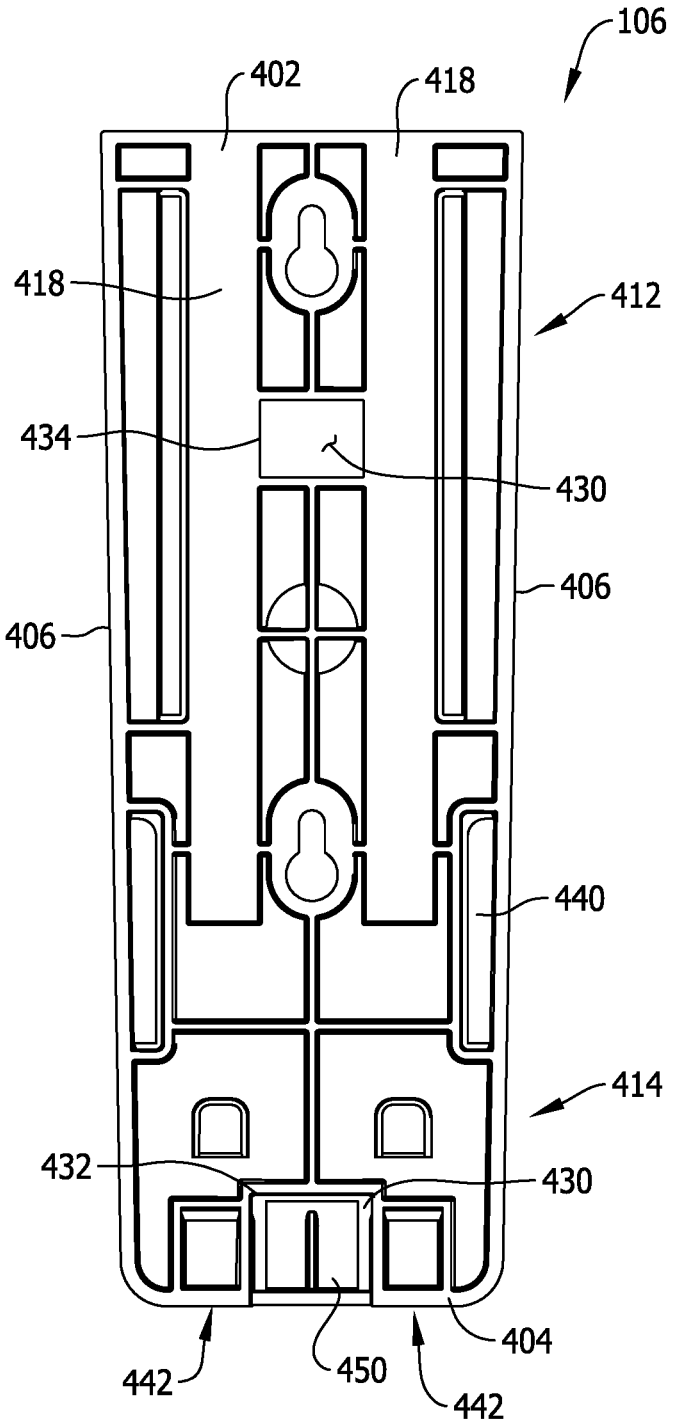
FIG. 8 is a back view of the mounting component shown in FIG. 6.

FIGS. 6-8 are various views of the mounting component 106 of the dispenser assembly 100 shown in FIG. 1. In particular, FIG. 6 is a perspective view of the mounting component 106, FIG. 7 is a front view of the mounting component 106, and FIG. 8 is a back view of the mounting component 106.

The mounting component 106 includes a back wall 402, a bottom wall 404, and two opposing side walls 406 integrally formed with the back wall 402 and bottom wall 404. Each side wall 406 includes an arcuate edge 408 and a front edge 410. In the example embodiment, the arcuate edge 408 is configured to be complementary to a shape of the body portion 202 of the bottle 102 (shown in FIGS. 2 and 3). Accordingly, when the dispenser assembly 100 is assembled, at least a portion of the body portion 202 of the bottle 102 may engage the arcuate edge 408 of at least one side wall 406 of the mounting component 106, such that the bottle 102 is supported within the dispenser assembly 100.

The back wall 402 includes, generally, a top region 412 and a bottom region 414. The back wall 402 of the mounting component 106 includes at least one mounting hole 416 defined therein in at least one of the top region 412 and the bottom region 414. The mounting hole 416 is configured to receive a mounting element (not shown) such as, without limitation, a nail head, a screw head, or a hook, upon installation of the dispenser assembly 100, such that the mounting component 106 may be substantially fixed to a wall or other support structure (not shown). The back wall 402 further includes at least one mounting panel 418, which is configured to receive an adhesive element (not shown), such as, for example, a mounting tape, to further secure the mounting component 106 (and, thereby, the dispenser assembly 100) to the wall or other support structure.

The mounting component 106 further includes two tracks 420, each track 420 generally defined by a lip 422 and a side face 424. The side face 424 extends from the back wall 402, and the lip 422 extends generally perpendicularly from the side face 424. Each track 420 is configured to receive a corresponding extension, extending from a back wall of the enclosure 110 (shown in FIG. 1). Each extension is received in a corresponding track 420 to engage with at least one of the lip 422 and the side face 424, thereby releasably coupling the extension to the mounting component 106 in a "tongue and groove"-type connection, upon assembly of the dispenser assembly 100. During refill of the dispenser assembly 100, the enclosure 110 is able to remain slidably coupled to the mounting component 106, as will be described later herein. The back wall 402 also includes at least one bracket 426 extending therefrom. Each bracket is configured to receive a bottom edge of a corresponding extension when the enclosure 110 engages the mounting component 106.

The back wall 402 further includes one or more locking slots 430 defined therein. In the example embodiment, the back wall 402 includes a closed position locking slot 432 and an open position locking slot 434. The closed position locking slot 432 is positioned in the bottom region 414 of the back wall 402 and defines an opening in the back wall 402. The open position locking slot 434 is positioned in the top region 412 of the back wall 402 and defines another opening therein. Generally, each locking slot 430 is configured to receive a locking tab disposed on a back wall of the enclosure 110. When the locking tab of the enclosure 110 engages the closed position locking slot 432 in a "snap fit" configuration, the dispenser assembly 100 may be referred to as being in a closed configuration. The closed configuration enables use of the dispenser assembly 100 by a user (i.e., to dispense product therefrom). When the locking tab of the enclosure 110 engages the open position locking slot 434 in a "snap fit" configuration, the dispenser assembly 100 may be referred to as being in an open configuration. The open configuration enables maintenance and manipulation (e.g., refill) of various components of the dispenser assembly 100, and in particular, the bottle 102. The transition from the closed configuration to the open configuration will be described later herein.

In the example embodiment, the front edge 410 of each side wall 406 is oriented substantially parallel to the back wall 402 of the mounting component 106 (i.e., substantially vertically). In other embodiments, the front edge 410 may be oriented other than parallel to the back wall 402. Each front edge 410 includes a lip 440 extending therefrom. In the example embodiment, the lip 440 is oriented substantially perpendicular to the side walls 406. In other embodiments, each lip 440 may be oriented other than perpendicular to the side walls. As will be described further herein, each lip 440 is configured to engage a corresponding projection on a back wall of the pump actuator assembly 108 (shown in FIG. 1) of the dispenser assembly 100, such that the pump actuator assembly 108 may be coupled to the mounting component 106 in a "tongue and groove"-type connection.

In order to further facilitate the coupling of the pump actuator assembly 108 with the mounting component 106, two troughs 442 and a locking tab 450 each project upwardly from the bottom wall 404 of the mounting component 106 (i.e., inwardly, with respect to the dispenser assembly 100 as a whole). Each trough 442 includes at least a front face 444 and two opposing side faces 446 defining a recess 448 therein. Each recess 448 is configured to receive a corresponding tab on the back wall of the bracing component 108, as will be described in further detail below. In the example embodiment, the locking tab 450 is disposed between the two troughs 442. In other embodiments, there may be more or fewer than two troughs 442 and/or more or fewer than one locking tab 450; and the locking tab(s) 450 and trough(s) 442 may be disposed in any arrangement suitable to facilitate the coupling of the bracing component 108 with the mounting component 106. The locking tab 450 includes a protuberance 452 configured to engage in a "snap fit" with a ridge formed on the back wall of the bracing component 108.

In the illustrated embodiment, the mounting component 106 further includes two support "feet" 460. The support feet 460 extend from each side wall 406 and from the bottom wall 404 of the mounting component. The support feet 460 are configured to engage with corresponding channels in the pump actuator assembly 108, as described further herein. In the illustrated embodiment, the support feet 460 are at least partially arcuate, to correspond to curved corners of the pump actuator assembly 108. In other embodiments, the support feet 460 may have any shape or configuration. Moreover, in some embodiments, the mounting component 106 may include no support feet or one "continuous" support foot that extends continuously between the side walls 406 of the mounting component 106.

It should be understood that the mounting component 106 may have different configurations, shapes, and sizes than those illustrated and described herein without departing from the present disclosure. The mounting component 106 may be made of any suitable material such as, without limitation, acrylonitrile-butadiene-styrene (ABS), or any other plastic, composite plastic, or thermoplastic resin. The mounting component 106 can be made in any desired color or colors, and may be transparent, translucent, or opaque.

Figure 9:
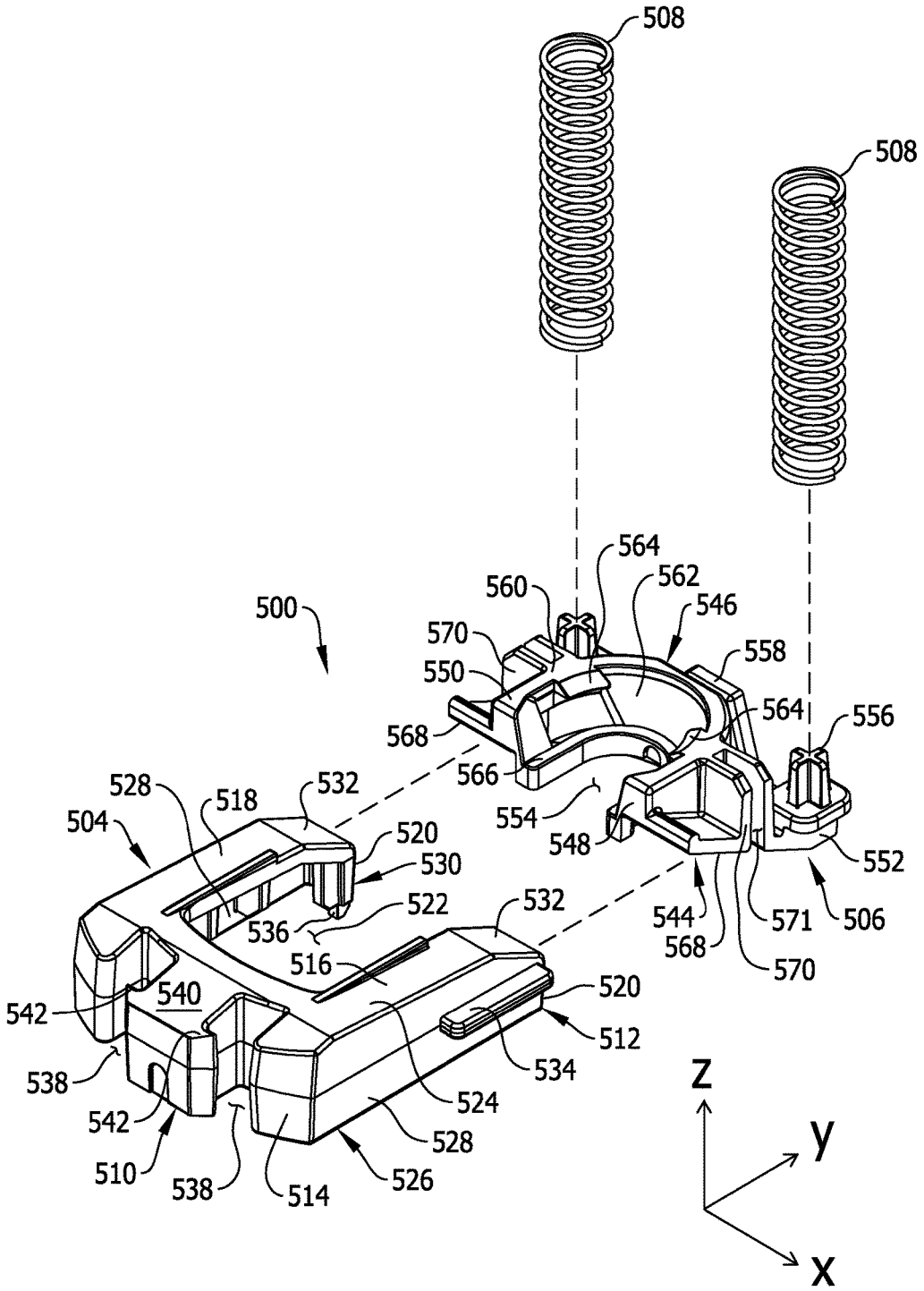
FIG. 9 is a first exploded view of a pump actuator assembly that may be used with the dispenser assembly shown in FIG. 1.
Figure 10:
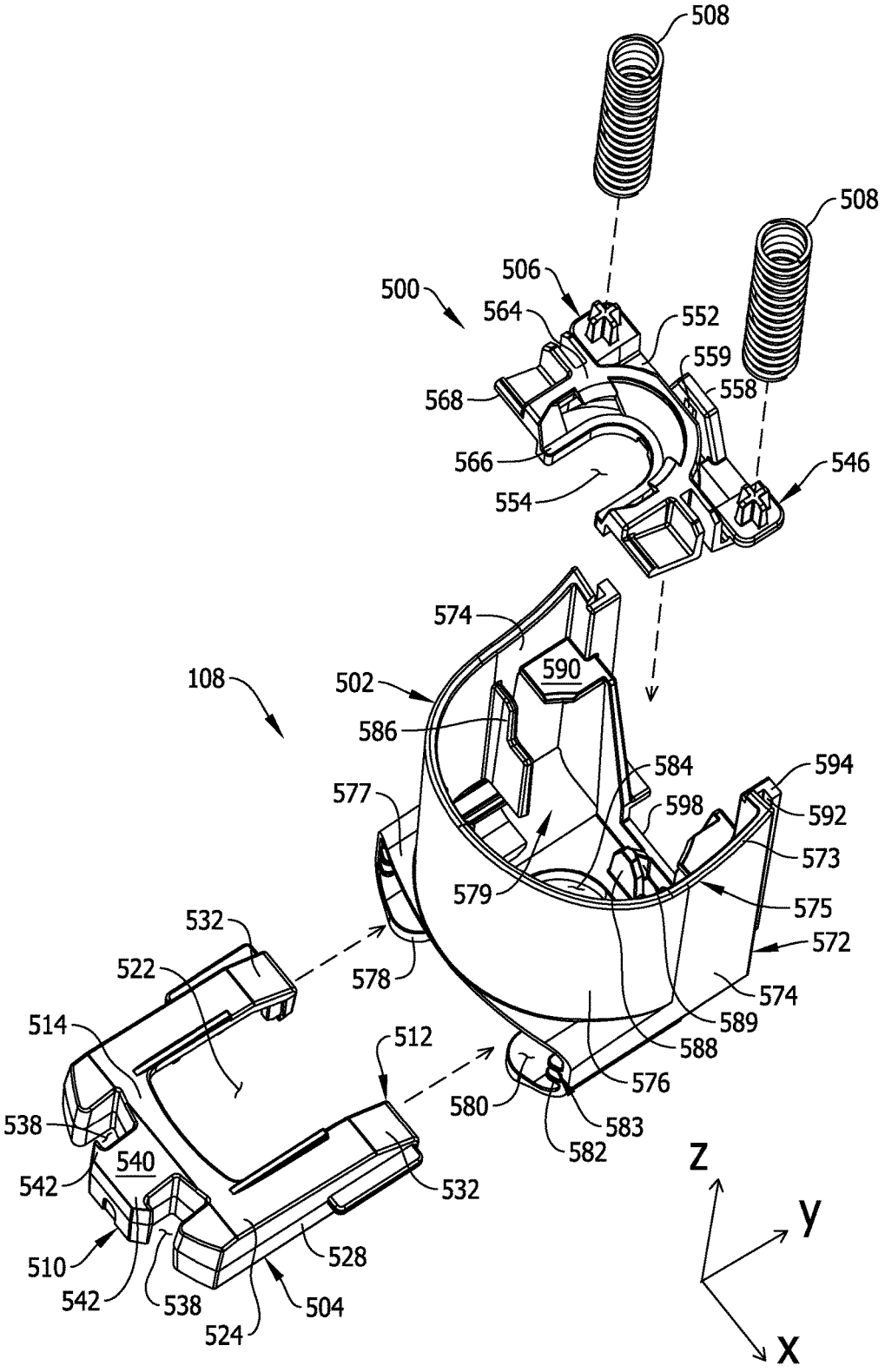
FIG. 10 is a second exploded view of the pump actuator assembly shown in FIG. 9.
Figure 11:
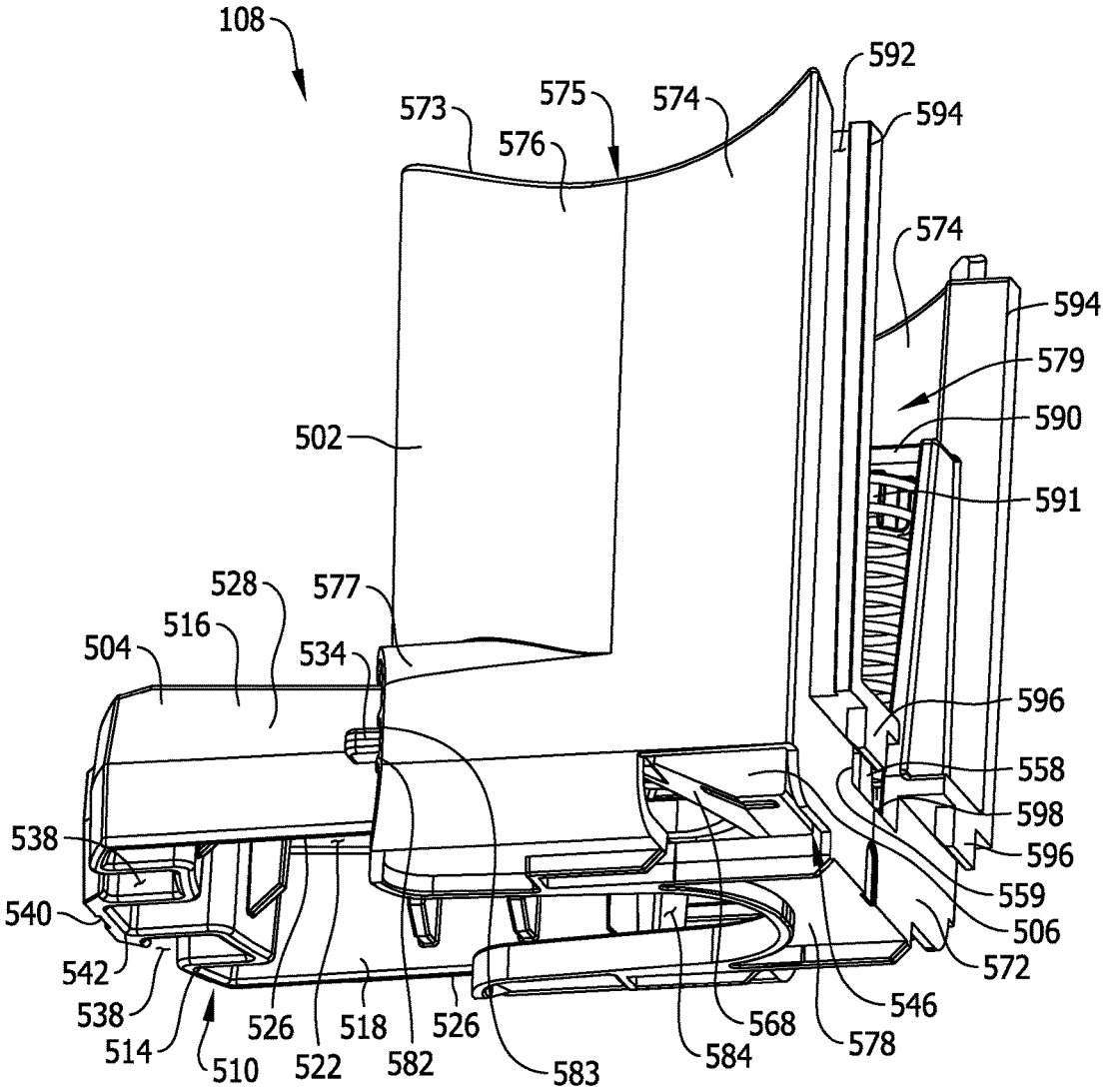
FIG. 11 is a bottom perspective view of the pump actuator assembly shown in FIG. 10.
Figure 12A:
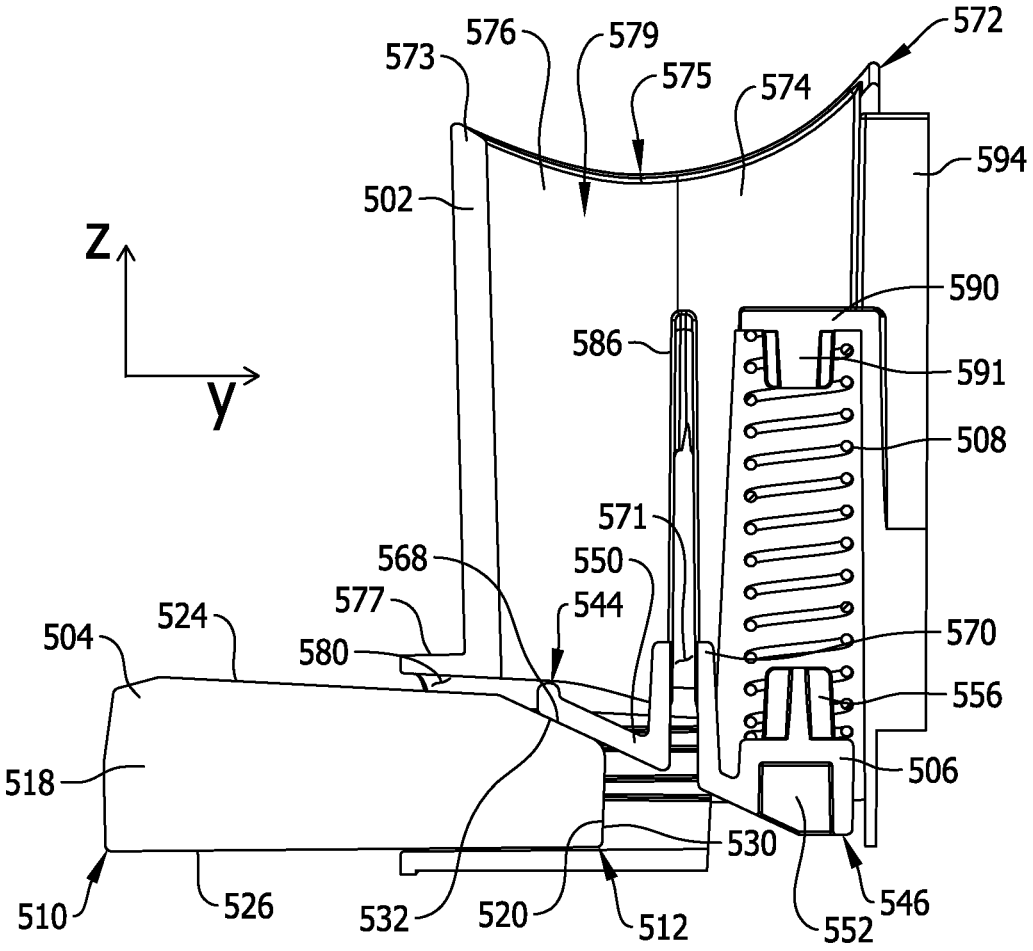
FIG. 12A is sectional view of the pump actuator assembly shown in FIG. 10 in a "ready" configuration.
Figure 12B:
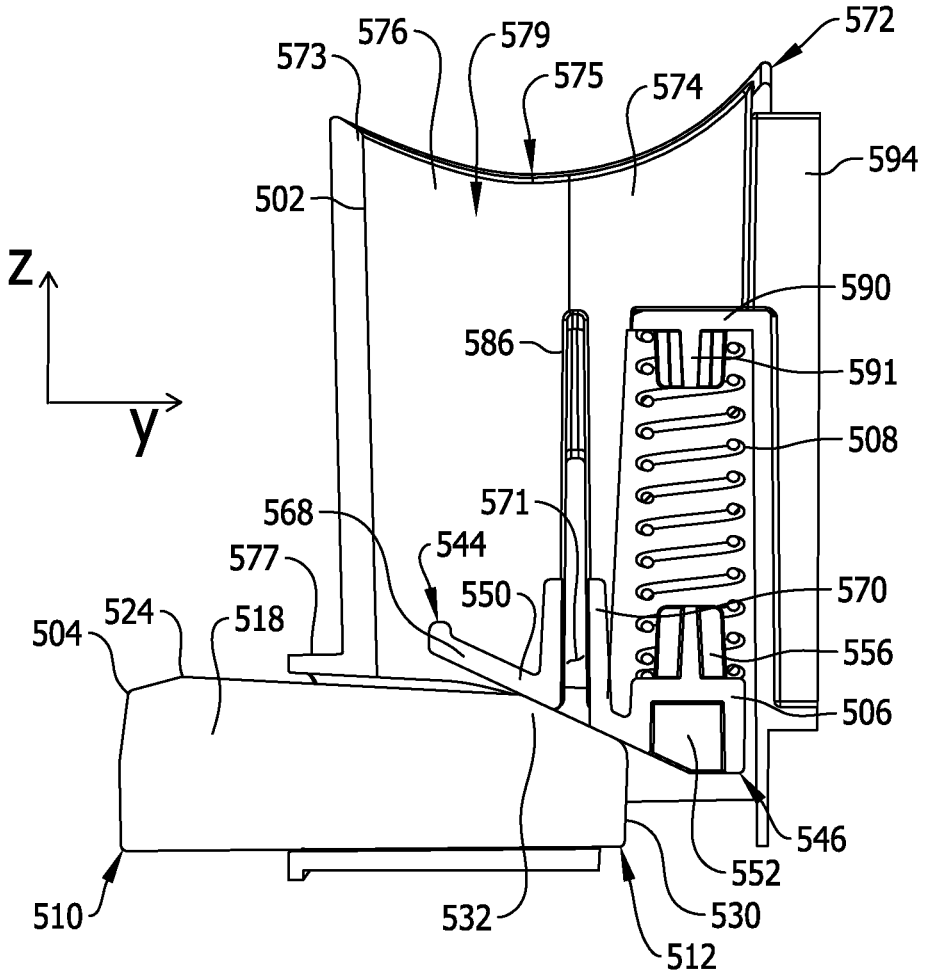
FIG. 12B is a sectional view of the pump actuator assembly shown in FIG. 12A in an "activated" configuration.
Figure 13:
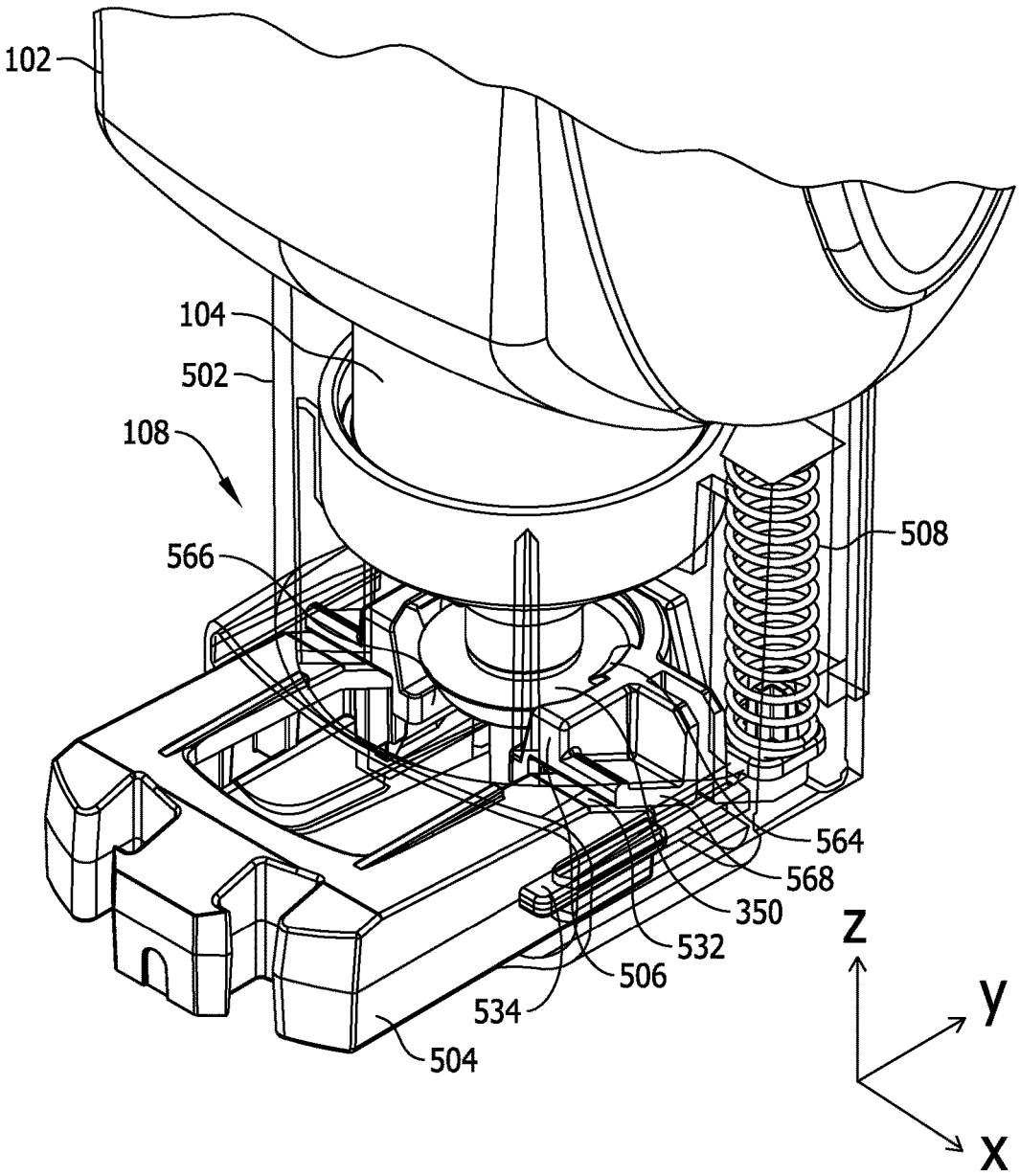
FIG. 13 is an expanded view of the pump actuator assembly shown in FIG. 10 in combination with the pump shown in FIG. 4 and the bottle shown in FIGS. 2 and 3.

FIGS. 9-13 are various views of the pump actuator assembly 108 of the dispenser assembly 100 shown in FIG. 1. In particular, FIG. 9 is a first exploded view of a plurality of internal components 500 of the pump actuator assembly 108, FIG. 10 is a second exploded view of the pump actuator assembly 108, FIG. 11 is a bottom perspective view of the assembled pump actuator assembly 108, FIG. 12A is a first sectional view of the pump actuator assembly 108 in a ready configuration, FIG. 12B is a second sectional view of the pump actuator assembly 108 in an activated or dispensing configuration, and FIG. 13 is a an expanded view of the pump actuator assembly 108 illustrating connection of the pump actuator assembly 108 with the pump 104 shown in FIG. 4. The axes shown in FIGS. 9, 10, 12A, 12B, and 13 are provided for reference and illustrate x, y, and z axes with respect to the dispenser assembly 100 as a whole. "Vertical," as used in the following description, refers generally to the z direction, and "horizontal" refers generally to the x-y plane (e.g., extending in the y direction and/or the x-direction).

The pump actuator assembly 108 includes a plurality of internal components 500 that are positioned at least partially within a casing 502 (see, for example, FIGS. 10-13) to assemble the pump actuator assembly 108. The internal components 500 include a first actuator 504, a second actuator 506, and two springs 508.

The first actuator 504 has a first end 510 and an opposing second end 512. The first end 510 is configured to extend outwardly with respect the dispenser assembly 100 (i.e., outwardly in the y direction), and the second end 512 is configured to extend inwardly with respect to the dispenser assembly 100 (i.e., inwardly in the y direction). The first actuator 504 includes a base 514 located generally at the first end 510 and two arms 516, 518. The arms 516, 218 extend from the base 514 and terminate at free ends 520 corresponding to the second end 512 of the first actuator 504. The two arms 516, 518 and the base 514 define a nozzle cutout 522, such that the first actuator 504 is generally U-shaped.

Each arm 516, 518 includes a top wall 524, a side wall 528, and a rear wall 530 (so called as it corresponds to a back- or rearward direction of the dispenser assembly 100). A lower ramp 532 extends at an angle between the top wall 524 and the rear wall 530, defining an angled surface therebetween. In addition, an extension 534 extends from the side wall 528 of each arm 516, 518, and a tab 536 extends downwardly from a bottom edge 526 of the side wall 528 (i.e., downwardly in the z direction, away from the top wall 524).

The base 514 includes two cutouts 538 defined therein, the cutouts 538 defining a projection 540 therebetween. the projection 540 includes two opposing flanges 542 that extend from the projection 540 into the cutouts 538. In an alternative embodiments, the base 514 only includes the projection 540 (i.e., without the cutouts 538).

The second actuator 506 includes a first end 544 and a second end 546. Broadly, the first end 544 includes two arms 548, 550 that extend from a base 552 at the second end 546. The arms 540, 550 and the base 552 define a nozzle cutout 554, such that the second actuator 506 is also generally U-shaped. The nozzle cutout 554 of the second actuator 506 is configured to (at least partially) align with the nozzle cutout 522 of the first actuator 504 when the pump actuator assembly 108 is assembled.

The base 552 of the second actuator 506 includes two pegs 556 configured to extend at least partially through corresponding springs 508 therearound. The size of the pegs 556 generally corresponds to an inner diameter of the springs 508. The base 552 also includes a vertically extending tab 558. The tab 558 has a cutout 559 defined therein.

The arms 548, 550 of the second actuator 506 each include a top wall 560 and a side wall 562 continuous between the arms 548, 550. One or more tabs 564 extend from the top wall 560 of each arm 548, 550 and from the side wall 562 into the nozzle cutout 554. In addition, a ledge 566 extends from the side wall 562 into the nozzle cutout 554, the ledge 566 spaced vertically from the tabs 564. As shown in FIG. 13, the tabs 564 and the ledge 566 cooperate to receive the flange 350 of the nozzle portion 306 of the pump 104 (also shown in FIG. 4) and each define a vertical "stop" limiting the vertical motion of the flange 350 with respect to the second actuator 506. The tabs 564 and the ledge 566 cooperate to ensure that the flange 350 (and, thereby, the nozzle portion 306) is appropriately actuated. The flange 350 is raised when the second actuator 506 is raised, and the flange 350 is drawn downwards when the second actuator 506 is lowered, as described further herein.

Each arm 548, 550 includes an upper ramp 568 that extends downward from the top wall 560, defining an angled surface. Each arm 548, 550 further includes a pair of extension walls 570 extending outwardly therefrom, opposite the nozzle cutout 554. Each pair of extension walls 570 define a channel 571 therebetween.

The casing 502 of the pump actuator assembly 108 includes a back wall 572, two side walls 574 extending generally "frontwards" therefrom, a front wall 576 extending from and arcuately connecting the side walls 574, and a bottom wall 578. The walls 572, 574, 576, 578 generally define a cavity 579 therein. The side walls 574 and the front wall 576 include a continuous top edge 573. In the example embodiment, the top edge 573 includes arcuate portions 575 arranged symmetrically therein. Each arcuate portion 575 is configured to be complementary to the shape of the body portion 202 of the bottle 102 (shown in FIGS. 2 and 3). Accordingly, when the dispenser assembly 100 is assembled, at least a portion of the body portion 202 of the bottle 102 may engage an arcuate portion 575 of the top edge 573 of the casing 502, such that the bottle 102 is supported and braced within the dispenser assembly 100.

The side walls 574, the bottom wall 578, and an intermediate partial wall 577 define a pair of base channels 580. Each base channel 580 receives a corresponding one of the arms 516, 518 of the first actuator 504 when the pump actuator assembly 108 is assembled. In addition, each side wall 574 includes a pair of rails 582 extending therefrom into a corresponding base channel 580. Each pair of rails 582 defines a groove 583 therebetween. Each groove 583 is configured to receive a corresponding extension 534 on one of the arms 516, 518, to couple the arms 516, 518 to the casing 502 and ensure suitable movement of the arms 516, 518 within the base channels 580. Further, the base channels 580 define a nozzle cutout 584 therebetween. The nozzle cutout 584 of the casing 102 is configured to (at least partially) align with the nozzle cutout 522 of the first actuator 504 and the nozzle cutout 554 of the second actuator 506 when the pump actuator assembly 108 is assembled, such that the nozzle portion 306 of the pump 104 is received the nozzle cutouts 584, 522, and 554 (as shown in FIG. 13).

The casing 502 includes a pair of ribs 586 extending inwards into the cavity 579 from the side walls 574 and the bottom wall 578, as well as a ridge 588 extending upwards into the cavity 579 from the bottom wall 578. When the second actuator 506 is installed in the casing 502, each channel 571 receiving a corresponding one of the ribs 586, between the corresponding pair of extension walls 570. In addition, the ridge 588 on the casing 502 extends through an opening (not shown) in the base 552 of the second actuator 506 to seat against the tab 558 on the base 552. The cutout 559 in the tab receives a protuberance 589 on the ridge 588, to couple the second actuator 506 to the casing 502.

The casing 502 further includes a pair of upper ledges 590 extending into the cavity 579 from the back wall 572 and the side walls 574. In the illustrated embodiment, the upper ledges 590 are substantially parallel to the bottom wall 578. As shown in FIGS. 11, 12A, and 12B, each upper ledge 590 has a corresponding peg 591 extending downwards from a bottom surface of the upper ledge 590. Once the second actuator 506 is installed in the casing 502, the springs 508 are installed. The springs 508 are seated on the pegs 556 of the second actuator 506 and are compressed to fit beneath the upper ledges 590, such that an upper end of the springs 508 is able to be seated over pegs 591 of the upper ledges 590. Accordingly, the springs 508 are in a constant state of compression and tension, and therefore tend to bias or urge the second actuator 506 downward, absent the presence of an opposing force. Although two springs 508 are included in the illustrated embodiment of the pump actuator assembly 108, it should be understood that a greater number of springs may be used, one spring may be used, or an alternative biasing component may be used, without departing from the scope of the disclosure.

When the internal components 500 are installed in the casing 502, the pump actuator assembly 108 is complete (see FIGS. 11-13). As shown in FIG. 12A, when the pump actuator assembly 108 is in a "ready" configuration (i.e., ready for use), the lower ramp 532 of the first actuator 504 is partially engaged with the upper ramp 568 of the second actuator 506. When the pump actuator assembly 108 is activated (i.e., during use of the dispenser assembly 100 to dispense liquid, gel, or foam product to a user), a force having a component defined in a first direction along a first axis (e.g., the y-axis) is exerted on the first end 510 of the first actuator 504, causing the first actuator 504 to move in the first direction parallel to the first axis (e.g., along the y-axis). The lower ramp 532 is therefore urged against the upper ramp 568, causing the upper ramp 568 to slide against the lower ramp 532. In so doing, the lower ramp 532 exerts a force having a component defined in a second direction along a second axis (e.g., the z-axis) on the upper ramp 568. In response, the second actuator 506 travels in the second direction parallel to the second axis (e.g., along the z-axis). The second actuator 506 drives the flange 350 of the pump 104 along the second axis (e.g., upwards) therewith to actuate the pump 104. In addition, the second actuator 506 further compresses the springs 508.

The first axis and the second axis may be perpendicular to one another (e.g., the y-axis is perpendicular to the z-axis). In alternative embodiments, the first axis and the second axis are other than perpendicular to one another. For example, the second axis forms an acute angle with respect to the first axis, or the second axis forms an obtuse angle with respect to the first axis. For example, the axes may form an angle between about 87 degrees and about 93 degrees relative to one another. In addition, the lower ramp 532 is oriented obliquely with respect to the first axis, and the upper ramp 568 is oriented obliquely with respect to the second axis. Depending on the orientation of the first and second axes, the lower ramp 352 may also be oriented obliquely with respect to the first axis, and/or the upper ramp 568 may be oriented obliquely with respect to the first axis.

When the force is removed from the first end 510 of the first actuator 504, the spring force of the (further compressed) springs 508 is exerted in a downward vertical (z) direction, urging the second actuator 506 opposite the second direction along the second axis (e.g., downwards along the z-axis). The upper ramp 568 is urged against the lower ramp 532. In so doing, the upper ramp 568 exerts a force having a component defined opposite the first direction along the first axis (e.g., outwards along the y-axis) on the lower ramp 532. In response, as the second actuator 506 is lowered, the first actuator 504 is forced opposite the first direction along the first axis (e.g., outwards along the y-axis). In addition, the second actuator 506 forces the flange 350 of the pump 104 downwards therewith.

The back wall 572 of the pump actuator assembly 108 defines channels 592. In the example embodiment, each channel 592 is generally defined by a pair of generally L-shaped projections 594 extending from the back wall 572. As described above with respect to FIGS. 6-8 and the discussion of the mounting component 106, each channel 592 is configured to receive a lip 440 of the mounting component 106 therein to facilitate coupling the pump actuator assembly 108 to the mounting component 106 during assembly of the dispenser assembly 100.

The back wall 572 further includes at least one tab 596 extending therefrom. In the example embodiment, each tab 596 is integrally formed with and adjacent to a projection 594. During assembly of the dispenser assembly 100, each tab 596 is inserted into a corresponding recess 448 of a trough 442 in the mounting component 106 (shown in FIG. 6). Each tab 596 engages in a friction fit with a front face 444

(shown in FIG. 6) of a corresponding trough 442 to couple the pump actuator assembly 108 to the mounting component 106. The back wall 572 further includes a lip 598 defined therein. The lip 598 is configured to engage in a friction fit with the protuberance 452 of the locking tab 450 of the mounting component 106 (also shown in FIG. 6). In the example embodiment, the lip 598 is disposed between two tabs 596. In other embodiments, there may be more or fewer than two tabs 596 and/or more or fewer than one lip 598, and the lip(s) 598 and tab(s) 598 may be disposed in any suitable arrangement to correspond with the corresponding recess(es) 448 and locking tab(s) 450 of the mounting component 106, to facilitate coupling of the pump actuator assembly 108 to the mounting component 106.

It should be understood that the pump actuator assembly 108 may have different configurations, shapes, and sizes than those illustrated and described herein without departing from the present disclosure. The pump actuator assembly 108 may be made of any suitable material such as, without limitation, ABS, or any other plastic, composite plastic, or thermoplastic resin. The pump actuator assembly 108 can be made in any desired color or colors, and may be transparent, translucent, or opaque.

Figure 14:
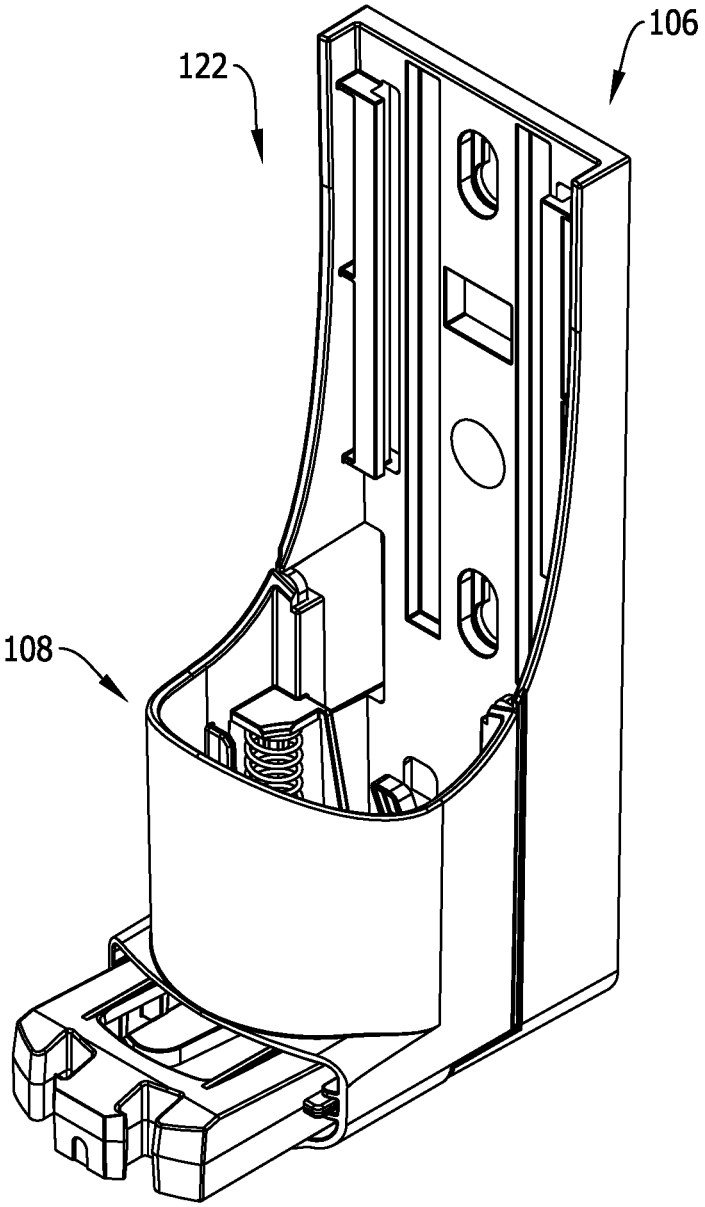
FIG. 14 is a perspective view of the dispenser assembly shown in FIG. 1 in another intermediate stage of assembly.

FIG. 14 is a perspective view of the dispenser assembly 100 shown in FIG. 1 in another intermediate stage of assembly. More particularly, a partial assembly 122 includes the pump actuator assembly 108 coupled to the mounting component 106, as described above. In one embodiment, the pump actuator assembly 108 and the mounting component 106 may be coupled together at a manufacturer location. In another embodiment, the pump actuator assembly 108 and the mounting component 106 may be coupled together during installation of the dispenser assembly 100. In one embodiment, the pump actuator assembly 108 and the mounting component 106 releasably couple together, whereas in another embodiment, the pump actuator assembly 108 and the mounting component 106 permanently couple together. The partial assembly 122 acts as a locating cradle for the partial assembly 120 (shown in FIG. 5), including the bottle 102 and the pump 104.

Figure 15:
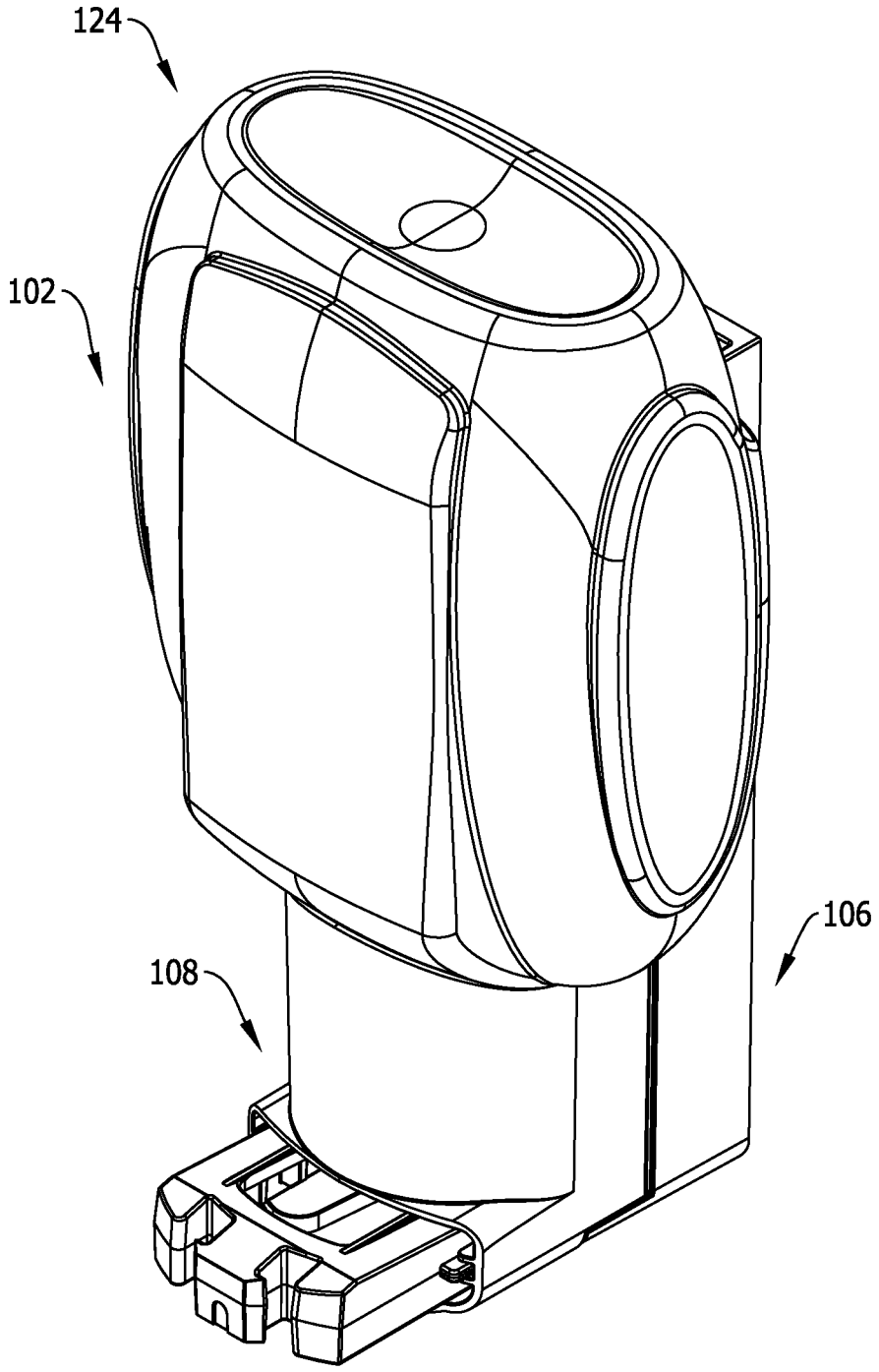
FIG. 15 is a perspective view of the dispenser assembly shown in FIG. 1 in another intermediate stage of assembly.

FIG. 15 is a perspective view of the dispenser assembly 100 shown in FIG. 1 in another intermediate stage of assembly. More particularly, FIG. 15 illustrates a partial assembly 124 including the bottle 102, the pump 104, the pump actuator assembly 108, and the mounting component 106. In other words, the partial assembly 124 includes the partial assembly 120 (shown in FIG. 5) coupled to the partial assembly 122 (shown in FIG. 14).

Figure 16:
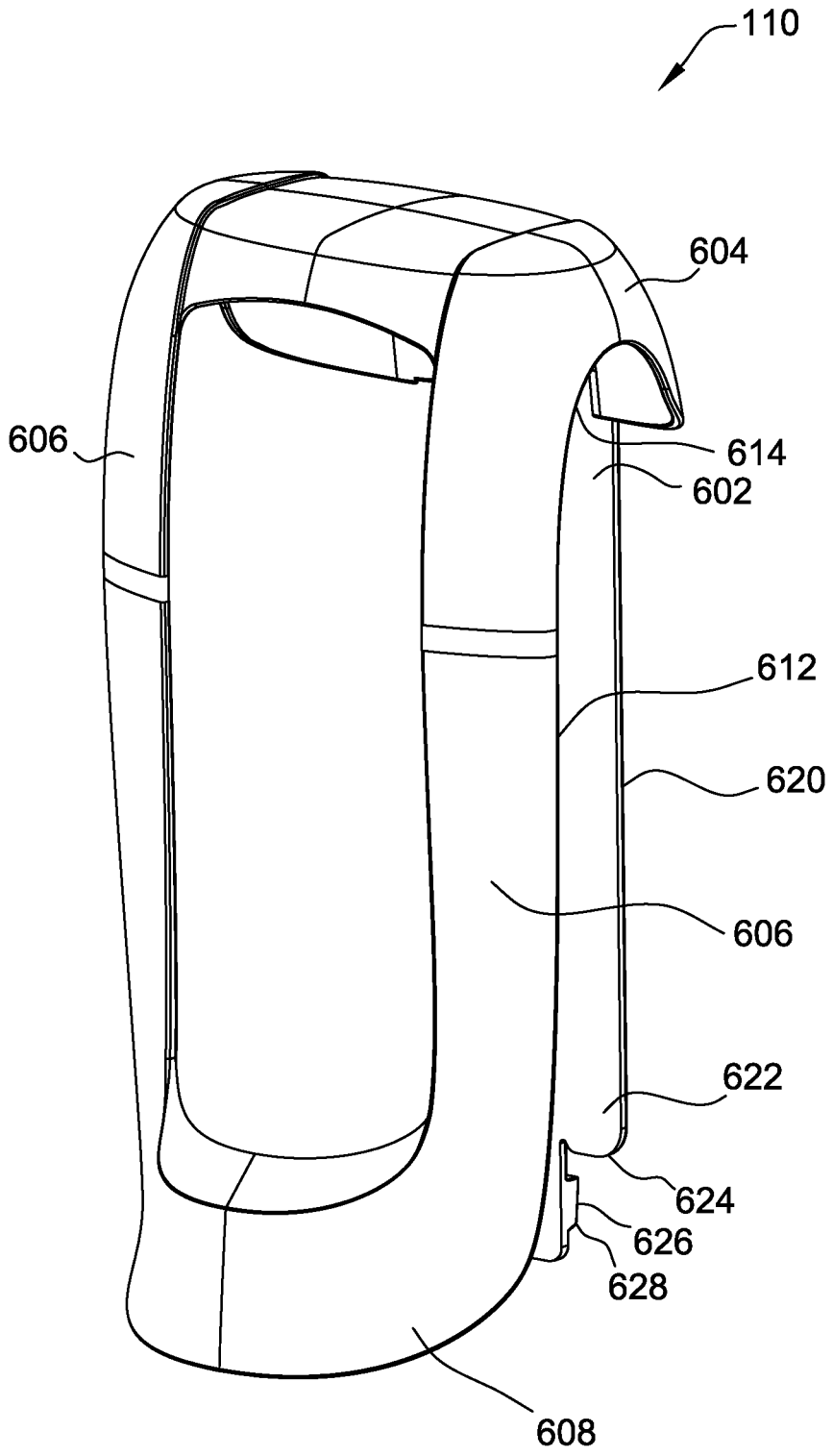
FIG. 16 is a perspective view of an enclosure that may be used with the dispenser assembly shown in FIG. 1.
Figure 17:
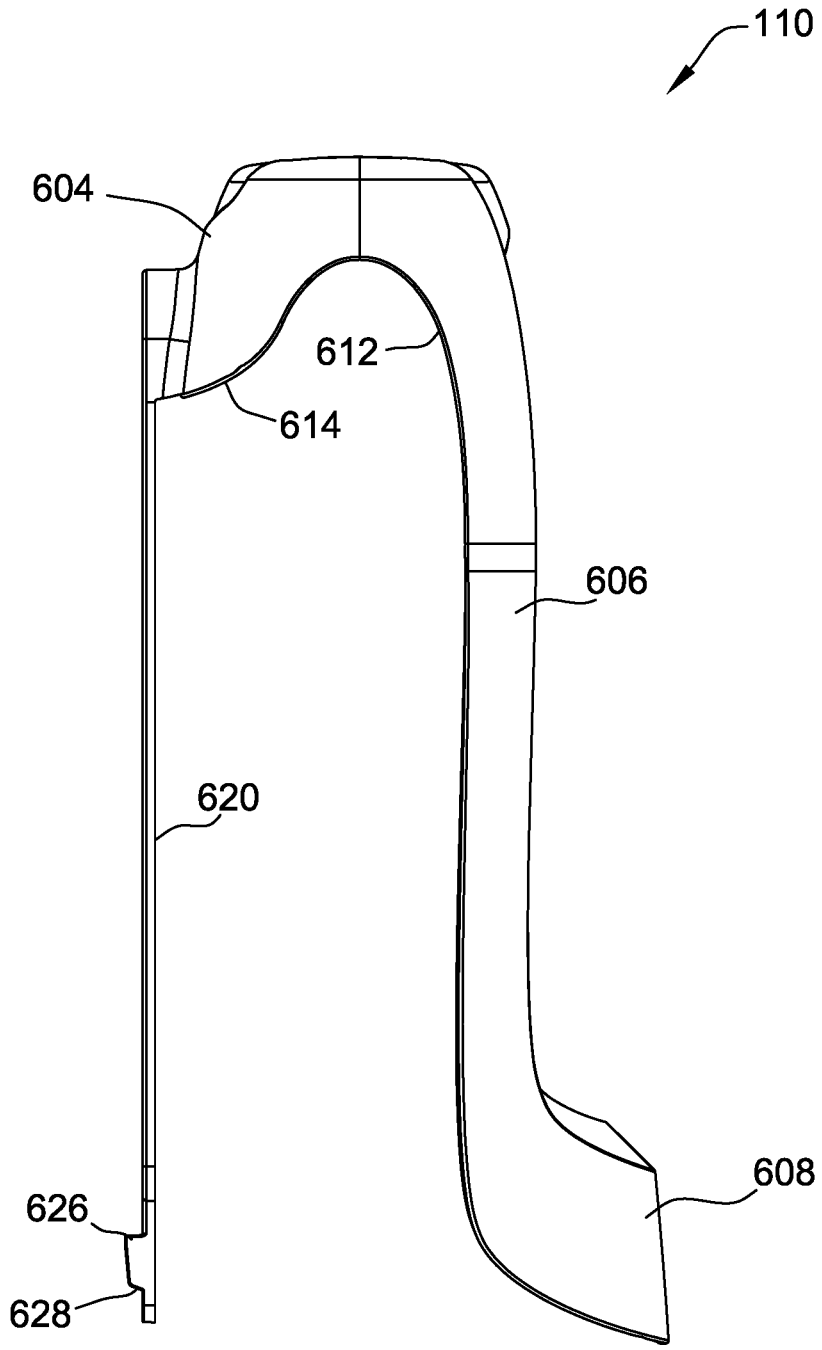
FIG. 17 is a side view of the enclosure shown in FIG. 16.
Figure 18:
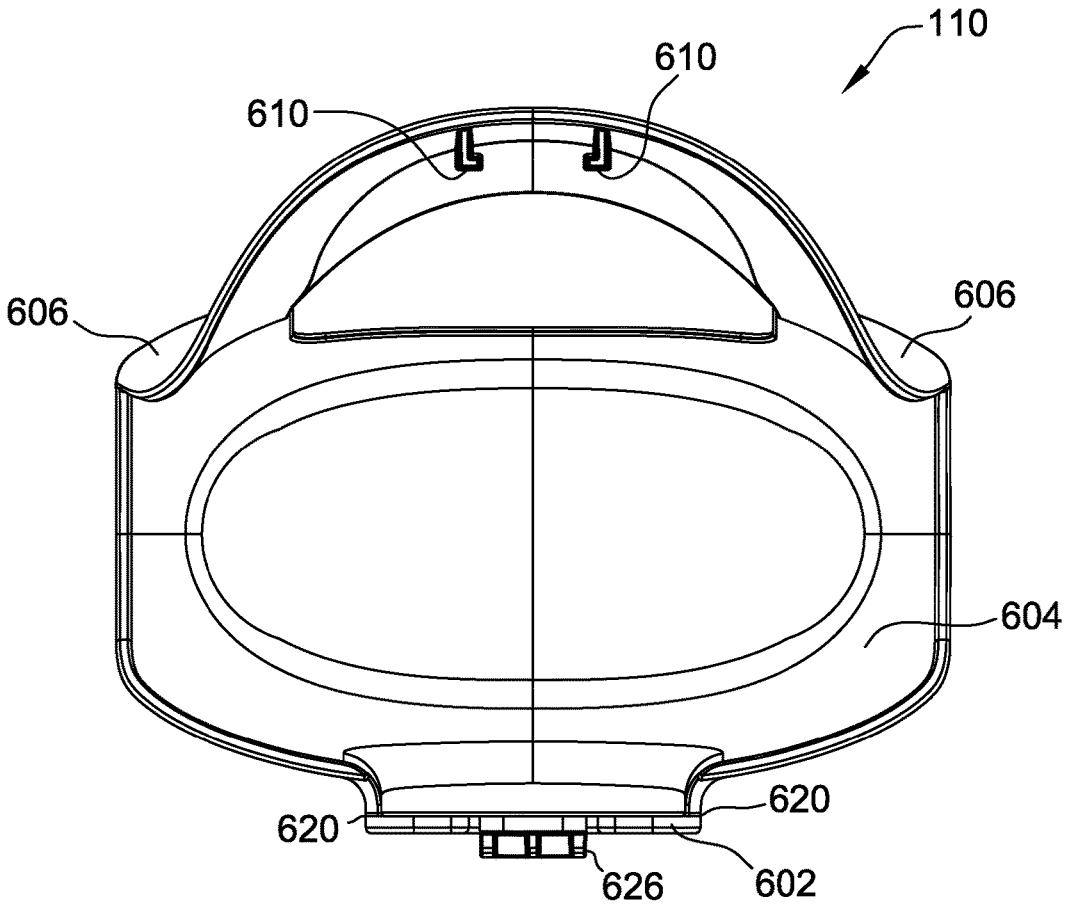
FIG. 18 is a bottom view of the enclosure shown in FIG. 16.

FIGS. 16-18 are various views of the enclosure 110 of the dispenser assembly 100 shown in FIG. 1. More particularly, FIG. 16 is a perspective view of the enclosure 110, FIG. 17 is a side view of the enclosure 110, and FIG. 18 is a bottom view of the enclosure 110.

The enclosure 110 includes a back wall 602 integrally formed with a top portion 604, which is itself integrally formed with at least one semi-rigid rib 606. As used herein, "semi-rigid" refers generally to a rigidity that allows a structure to maintain a predetermined form when not acted upon by a force, and that is flexible enough to bend without breaking when acted upon by a force. In the example embodiment, the enclosure 110 includes two semi-rigid ribs 606 integrally formed with and bridged by a handle portion 608. The handle portion 608 may be rigid or semi-rigid. In other embodiments, the handle portion 608 may be other than integrally formed with the semi-rigid ribs 606 and may include additional components such as a cushioning member (e.g., for cushioning a user's palm during use of the dispenser assembly 100), a sanitizing member (e.g., an antibacterial material and/or coating disposed thereon), and/or indicia (e.g., to direct a user to press or push on the handle, rather than pull). The enclosure 110 is configured such that, when the dispenser assembly 100 is assembled, a user may impose a pushing force on the handle portion 608, which causes the semi-rigid ribs 606 to bend slightly. Thus, the handle portion 608 may be depressed (i.e., moved inwardly, with respect to the dispenser assembly 100 as a whole) without movement of the entire enclosure 110. The back wall 602 of the enclosure 110 remains fixed with respect to the dispenser assembly 100 during operation.

The handle portion 608 of the enclosure 110 includes a pair of symmetrical brackets 610 integrally formed therewith, as best seen in FIG. 18. Each bracket 610 is configured to receive a corresponding one of the flanges 542 on the projection 540 on the first end 510 of the first actuator 504 (shown in FIGS. 9-11) when the enclosure 110 is installed first actuator 504 is thereby fixed relative to the handle portion 608 of the enclosure 110. Moreover, the configuration of the brackets 610 about the flanges 542 ensures that the nozzle portion 306 (shown in FIG. 4) of the pump 104 will be in a "ready" configuration (i.e., positioned vertically downwards) when the enclosure 110 is in a "ready" configuration (i.e., undepressed and ready for use); and that the nozzle portion 306 will always be depressed at the same rate as the handle portion 608 of the enclosure 110. In addition, operatively coupling the handle portion 608 to the first actuator 504 further ensures that the handle portion 608 will be returned to the "ready" configuration after depression thereof (during use of the dispenser assembly 100). The first actuator 504 is biased into a "ready" configuration by the springs 508, as described above, and will therefore urge handle portion 608 back into the "ready" configuration correspondingly.

An additional benefit of the configuration of the brackets 610 about the flanges 542 of the first actuator 504 is that a user is substantially prevented from pulling the handle portion 608 away from the first actuator 504, preventing user frustration and confusion about the functionality of the dispenser assembly 100. In at least some embodiments, the outlet 348 of the nozzle portion 306 may extend slightly past a bottom of the handle portion 608, such that product dispensed from the outlet 348 does not contact any part of the handle portion 608.

In the example embodiment, the semi-rigid ribs 606 are spaced apart from each other to accommodate the bulge 212 of the bottle 102 (shown in FIGS. 2 and 3) when the dispenser assembly 100 is assembled. In addition, the semi-rigid ribs 606 are shaped to conform to the front 206 of the body portion 202 of the bottle 102 (also shown in FIGS. 2 and 3). The top portion 604 and the semi-rigid ribs 606 are defined by a generally elliptical outer edge 612 and a shoulder edge 614. In the example embodiment, the elliptical outer edge 612 is configured to be complementary to the generally elliptical edge 222 of the outwardly projecting rim 220 on the bottle 102 (also shown in FIGS. 2 and 3). Moreover, the shoulder edge 614 is configured to be complementary to a shape of the ridge 214 of the bottle 102 (also shown in FIGS. 2 and 3). Accordingly, when the dispenser assembly 100 is assembled, the elliptical outer edge 612 and shoulder edge 614 of the enclosure 110 are coupled substantially against, respectively, the outwardly projecting rim 220 and ridge 214 of the bottle 102. In addition, the top portion 604 and the semi-rigid ribs 606 are substantially flush with at least a portion of the body portion 202 of the bottle 102. Not only is the bottle 102 secured by the enclosure 110, but the result is aesthetically pleasing, as the dispenser assembly 100 has a substantially smooth surface.

The back wall 602 of the enclosure 110 is generally defined by two opposing side edges 620. The side edges 620 further define a pair of symmetrical extensions 622. The extensions 622 are configured to be slidably inserted into the track 420 of the mounting component 106 (shown in FIGS. 6 and 7), to install the enclosure 110 into the mounting component 106 and onto the dispenser assembly 100. Accordingly, the enclosure 110 is easily removed from and inserted into the mounting component 106 for installation and subsequent maintenance (e.g., cleaning or replacement). Each extension 622 includes a bottom edge 624. When the enclosure 110 is coupled to the mounting component 106, each bottom edge 624 couples to a corresponding bracket 426 of the mounting component 106 (also shown in FIGS. 6 and 7) to ensure accurate placement of the enclosure 110 into the mounting component 106. When each bottom edge 624 is coupled to a corresponding bracket 426, in the example embodiment, a locking tab 626 defined on the back wall 602 of the enclosure 110 is positioned to engage in a "snap fit" with the closed position locking slot 432 of the mounting component 106 (shown in FIGS. 6-8). In other words, the enclosure 110 is at its lowest position with respect to the mounting component 106, and the dispenser assembly 100 is in its closed configuration. The locking tab 626 includes an angled protuberance 628, which enables depression of the locking tab 626 by a force directed upwards (i.e., in the z direction).

It should be understood that the enclosure 110 may have different configurations, shapes, and sizes than those illustrated and described herein without departing from the present disclosure. The enclosure 110 may be made of any suitable material such as, without limitation, polycarbonate (PC), ABS, or any other plastic, composite plastic, or thermoplastic resin or combination thereof. The enclosure 110 can be made in any desired color or colors, and may be transparent, translucent, or opaque.

Figure 19:
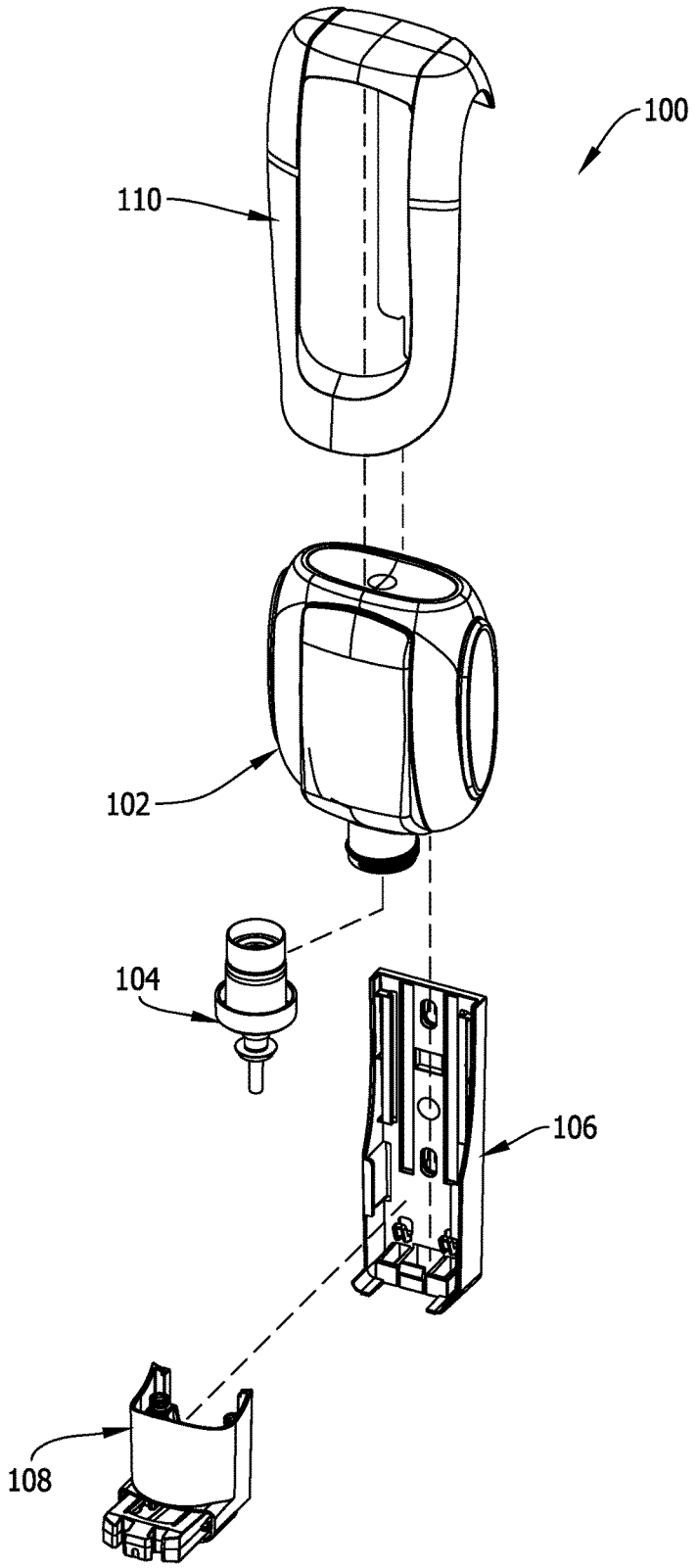
FIG. 19 is an exploded view of the dispenser assembly shown in FIG. 1.

FIG. 19 is an exploded view of the dispenser assembly 100 shown in FIG. 1. The dashed lines represent relative movement of the various components to assemble the dispenser assembly 100. In particular, the pump 104 is coupled to the bottle 102 to form the partial assembly 120 (shown in FIG. 5). The pump actuator assembly 108 is coupled to the mounting component 106 to form the partial assembly 122 (shown in FIG. 14). The partial assembly 120 is coupled to the partial assembly 122, forming the partial assembly 124 (shown in FIG. 15). Finally, the enclosure 110 is coupled to the partial assembly 124 (in particular, to the mounting component 106). It should be understood that the order described above is described for example only, and that the dispenser assembly 100 can be assembled in any other suitable order to form the dispenser assembly 100 described herein.

Figure 20:
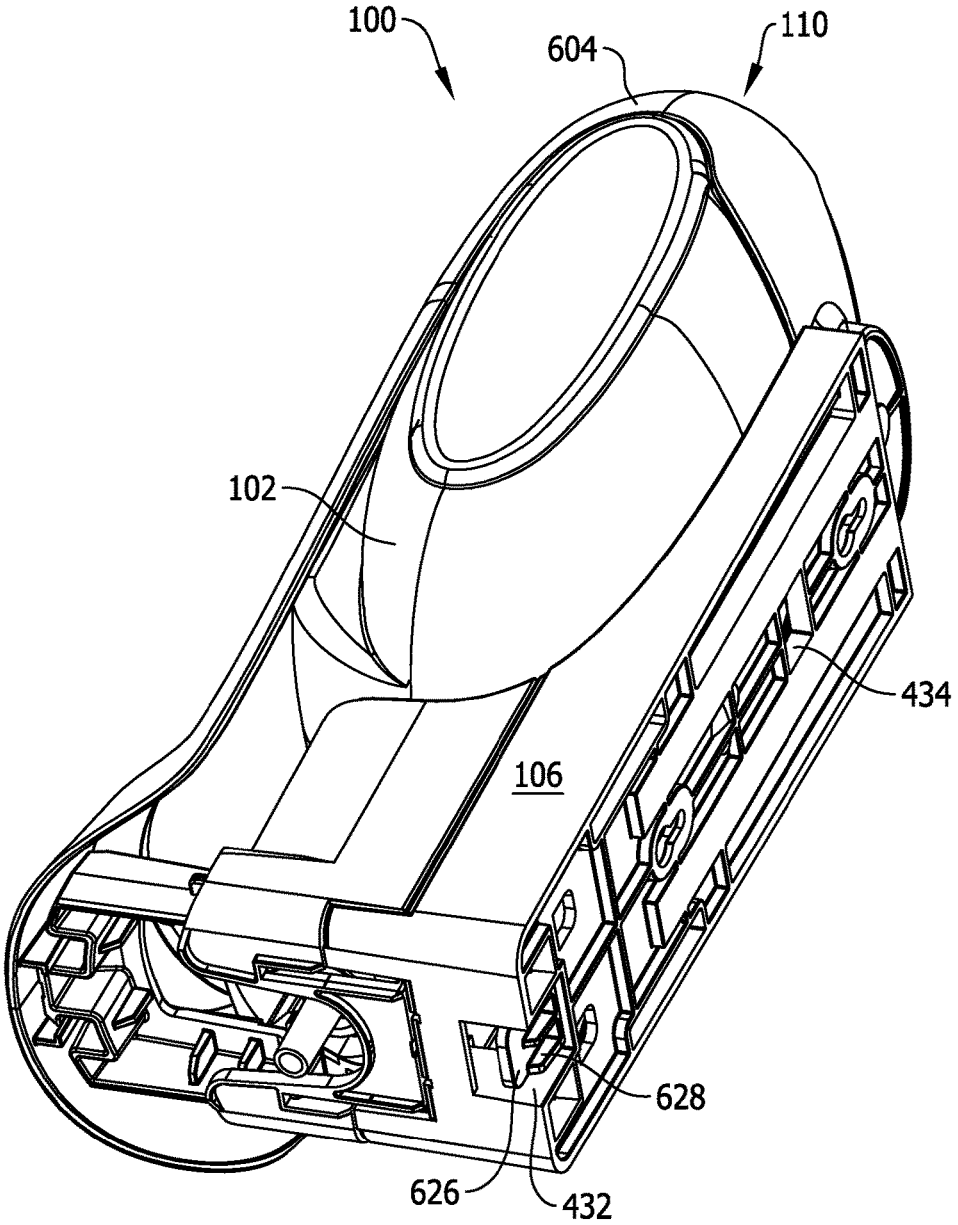
FIG. 20 is a perspective view of the dispenser assembly shown in FIG. 1 in a closed configuration.
Figure 21:
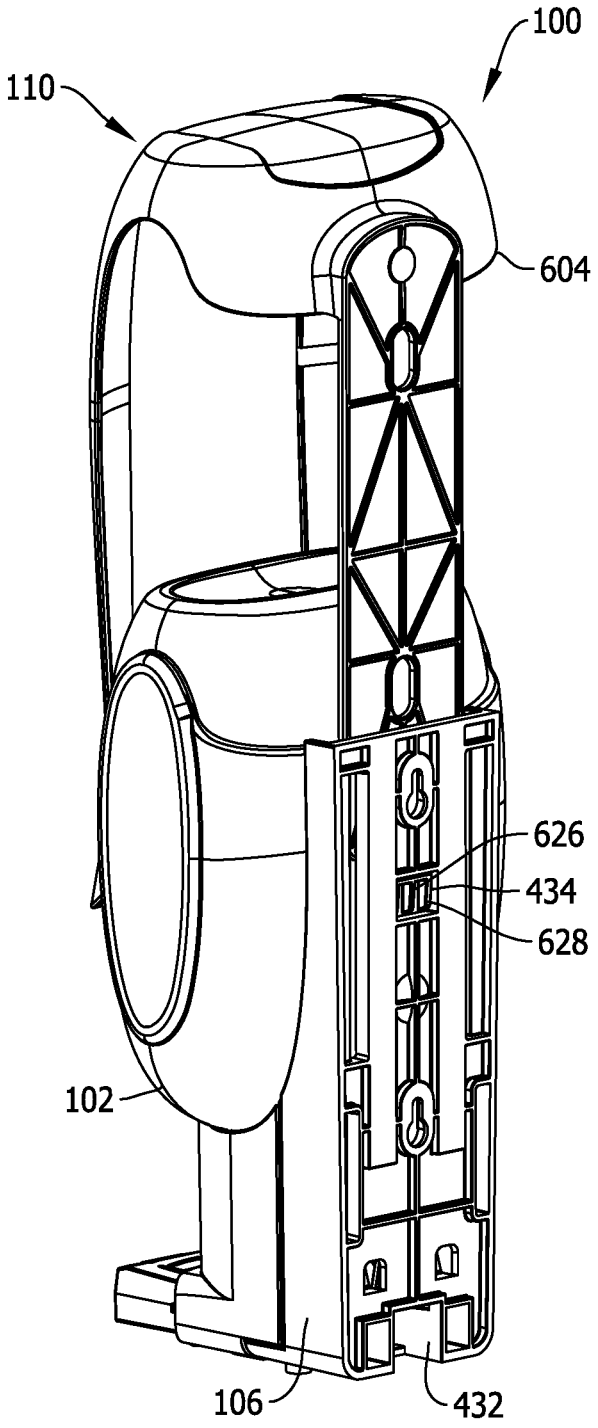
FIG. 21 is a perspective view of the dispenser assembly shown in FIG. 1 in an open configuration.

FIGS. 20 and 21 illustrate the transition of the dispenser assembly 100 from the closed configuration to the open configuration. More particularly, FIG. 20 is a perspective view of the dispenser assembly 100 shown in FIG. 1 in the closed configuration, and FIG. 21 is a perspective view of the dispenser assembly 100 shown in FIG. 1 in the open configuration. The locking tab 626 of the enclosure 110 (shown in FIGS. 16-18) is engaged with the closed position locking slot 432 of the mounting component 106 (shown in FIGS. 6-8). By depressing the locking tab 626 (i.e., moving the locking tab 626 inward, with respect to the dispenser assembly 100), the enclosure 110 is decoupled from the mounting component 106 and released from the closed configuration. The enclosure 110 may be slidably moved upwards with respect to the mounting component 106. More particularly, the extensions 622 of the enclosure 110 (also shown in FIGS. 16-18) may slide within the track 420 of the mounting component 106 (shown in FIGS. 6 and 7) until the locking tab 626 engages with the open position locking slot 434 (shown in FIGS. 6-8) to transition the dispenser assembly 100 from the closed to the open configuration. When the dispenser assembly 100 is in the open configuration, the bottle 102 is easily accessible for removal and/or refill (and/or other maintenance of the dispenser assembly 100). Accordingly, refill of the dispenser assembly 100 is simplified. The entire dispenser assembly 100 need not be removed from the wall; refill and/or other maintenance may be performed by only adjusting the enclosure 110. Further, no additional parts (e.g., keys) are needed to refill the dispenser assembly 100.

In the example embodiment, a user may return the dispenser assembly 100 to the closed configuration by applying pressure to the top portion 604 of the enclosure 110 (shown in FIGS. 16-18). This causes a bottom edge of the open position locking slot 434 to exert an upward force on the angled protuberance 628 of the locking tab 626 (shown in FIGS. 16 and 17), forcing the locking tab 626 inwards and out of engagement with the open position locking slot 434. Thereby the enclosure 110 can be moved downwards until the locking tab 626 engages with the closed position locking slot 432, (reversibly) locking the dispenser assembly 100 in the closed configuration.

Referring generally now to FIGS. 1-21, when the dispenser assembly 100 is fully assembled, all components are substantially fixed with respect to the dispenser assembly 100 as a whole, except for the handle portion 608 of the enclosure 110, the actuators 504, 506 of the pump actuator assembly 108 and the nozzle portion 306 of the pump 104. To use the dispenser assembly 100, a user may place the palm of his or her hand against the handle portion 608 of the enclosure 110 and exert a pushing force thereon. The handle portion 608 is depressed inwardly with respect to the dispenser assembly 100, and the handle portion 608 engages with the first actuator 504 to cause "inward" and "rearward" motion of the first actuator 504 in the first direction along the first axis. As described above, this inward motion of the first actuator 504 causes "inward" and "upward" motion of the second actuator 506 in the second direction along the second axis. Upward motion of the second actuator 506 causes upward motion of the flange 350 of the nozzle portion 306, thereby activating the dispensing functionality of the pump 104 as described above. In one example embodiment, depressing the handle portion 608 about ¾ inch causes about 0.8 mL of product to be dispensed from the outlet 358 of the nozzle portion 306 into the hand of the user. If alternative embodiments of a pump 104 are used with the dispenser assembly 100, the amount of product dispensed may be greater than or less than 0.8 mL. Moreover, more or less than 0.8 mL may dispensed in various formats of product, such as a liquid, gel, or foam product. The user need not contact any part of the nozzle portion 306 in order to receive dispensed product.

It is contemplated that a user may exert the pushing force on the handle portion 608 using means other than the palm of his or her hand. For example, a user may use his or her fingers, fist, elbow, or forearm to dispense a product into a receptacle (e.g., a handle, a bottle, or any other receptacle). As such, the embodiments disclosed herein may be easier to use than traditional dispensers for people with various disabilities and may be compliant with the Americans with Disabilities Act (ADA). The examples described herein are not meant to limit use of the dispenser assembly 100 to a particular embodiment or product.

The disclosure provides a minimal dispenser assembly that requires less plastic casing and that features an easily replaceable, invertible bottle. The bottle may be used in an upright or inverted orientation. The minimal design reduces maintenance and is thereby relatively cost efficient as compared to at least some known designs. Moreover, the disclosure provides a dispenser assembly with a nozzle that enables the use of multiple formats of product to be dispensed, including liquids, foams, and gels, providing flexibility in its use.

Embodiments of the disclosure may provide advantages such as, for example, a minimal design that reduces manufacture, maintenance, and/or replacement costs of dispenser assemblies. The minimal design described herein also enhances the aesthetic appeal of the dispenser assembly 100. In addition, the materials used in the manufacture of the bottle 102 may be more environmentally friendly than at least some known bottles. The dispenser assembly 100 described herein provides full visibility of the bottle (e.g., bottle 102), eliminating the need for a sight window for determination of when a refill is needed. Further, the mounting component 106 is easily installed and allows for simple installation of the entire dispenser assembly 100. Moreover, the dispenser assembly 100 has a low profile such that it can be installed in a variety of locations, promoting ease of access and hand hygiene compliance.

Further advantages include that refill bottles (e.g., a bottle 102) designed to be used with the dispenser assembly 100 may also be used in a stand-alone configuration with a traditional pump, as described above, which enables the unification of a design aesthetic when using a stand-alone bottle 102 in combination with the dispenser assembly 100. Moreover, the design of the dispenser assembly 100 enables the use of a wide variety of refill products in a variety of formats (e.g., liquid, foam, gel) without the need to exchange any components of the dispenser assembly 100 other than the bottle 102. Personalization of the dispenser assembly 100 is also simple, in that replacement/exchange of the enclosure 110 (e.g., an enclosure 110 of a new color or pattern) is easily performed without need to replace/exchange any other components of the dispenser assembly 100.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements. Like references in the figures indicate like elements, unless otherwise indicated.

As various changes could be made in the above without departing from the scope of the disclosure, it is intended that all matter contained in the above description and shown in the accompanying drawings shall be interpreted as illustrative and not in a limiting sense.

What is claimed is:

1. A dispenser assembly comprising:

a container configured to be filled with a product;

a pump connected to the container and configured to control dispensing of the product from the container;

a pump actuator assembly configured to actuate the pump and retain the container and the pump, the pump actuator assembly comprising:

a first actuator including a lower ramp; and a second actuator including an upper ramp engaged with the lower ramp, the lower ramp of the first actuator and the upper ramp of the second actuator cooperating to actuate at least a portion of the pump along a first axis in response to a force applied along a second axis;

a mounting component; and an enclosure connected to the mounting component and engaging the container, wherein the enclosure comprises a top portion, a pair of ribs extending from the top portion, and a handle portion extending between the pair of ribs, wherein the first actuator is coupled to the handle portion such that depressing the handle portion applies the force along the second axis to the first actuator.

2. The dispenser assembly in accordance with claim 1, wherein the lower ramp exerts a force along the first axis on the upper ramp in response to the force applied along the second axis.

3. The dispenser assembly in accordance with claim 1, wherein the pump comprises a radially extending flange.

4. The dispenser assembly in accordance with claim 3, wherein the second actuator retains the flange therein to couple the pump to the second actuator.

5. The dispenser assembly in accordance with claim 1, wherein the pump actuator assembly further comprises a casing surrounding at least a portion of the first and second actuators.

6. A dispenser assembly in accordance with claim 1, wherein the handle portion comprises a pair of symmetrical brackets that directly engage corresponding flanges on the first actuator.

7. A dispenser assembly in accordance with claim 1, wherein the pump actuator assembly further comprises at least one spring that exerts a bias force against the second actuator.

8. A dispenser assembly, the dispenser assembly comprising:

a container;

a pump coupled to the container, the pump comprising a chamber portion and a nozzle, the pump actuatable in response to a force exerted along a first axis on the nozzle;

a pump actuator assembly operatively coupled to the nozzle of the pump, the pump actuator assembly configured to exert the force along the first axis on the nozzle in response to a force applied along a second axis to the pump actuator assembly;

a mounting component; and an enclosure connected to the mounting component and engaging the container, wherein the enclosure comprises a top portion, a pair of ribs extending from the top portion, and a handle portion extending between the pair of ribs, wherein the pump actuator assembly is coupled to the handle portion such that depressing the handle portion applies the force along the second axis to the pump actuator assembly.

9. The dispenser assembly in accordance with claim 8, wherein the nozzle of the pump comprises a radially extending annular flange, and wherein the pump actuator assembly is operatively coupled to the annular flange.

10. The dispenser assembly in accordance with claim 9, wherein the pump actuator assembly comprises at least one radially extending tab and at least one radially extending ledge axially spaced from the at least one tab, wherein the at least one tab and ledge cooperate to retain the annular flange therebetween.

11. The dispenser assembly in accordance with claim 8, wherein the pump actuator assembly comprises a first actuator and a second actuator, wherein the first actuator exerts the force along the first axis on the second actuator in response to the force applied along the second axis to the first actuator.

12. The dispenser assembly in accordance with claim 11, wherein the first actuator comprises at least one lower ramp, wherein the second actuator comprises at least one upper ramp engaged with the lower ramp, and wherein the lower ramp exerts the force along the first axis on the upper ramp in response to the force applied along the second axis.

13. A dispenser assembly in accordance with claim 11, wherein the handle portion comprises a pair of symmetrical brackets that directly engage corresponding flanges on the first actuator.

14. A dispenser assembly in accordance with claim 11, wherein the pump actuator assembly further comprises at least one spring that exerts a bias force against the second actuator.

15. A dispenser assembly in accordance with claim 14, wherein the bias force of the at least one spring acts against the force applied along the second axis to return the pump actuator assembly to a ready configuration.

16. A dispenser assembly in accordance with claim 8, wherein the pump actuator assembly comprises a casing that retains the pump therein.

* * * * *